US008059998B2

(12) United States Patent
Koike

(10) Patent No.: US 8,059,998 B2
(45) Date of Patent: Nov. 15, 2011

(54) IMAGE FORMING DEVICE ADAPTED TO CONTROL SPEED DIFFERENCE BETWEEN FIRST ROTARY MEMBER AND SECOND ROTARY MEMBER

(75) Inventor: Takahisa Koike, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 472 days.

(21) Appl. No.: 12/125,993

(22) Filed: May 23, 2008

(65) Prior Publication Data

US 2008/0298856 A1 Dec. 4, 2008

(30) Foreign Application Priority Data

May 31, 2007 (JP) ..... 2007-145536
Apr. 23, 2008 (JP) ..... 2008-112673

(51) Int. Cl.
*G03G 15/01* (2006.01)

(52) U.S. Cl. ..... 399/302; 399/303

(58) Field of Classification Search ..... 399/301, 399/302
See application file for complete search history.

(56) References Cited

U.S. PATENT DOCUMENTS

| | | | | |
|---|---|---|---|---|
| 5,243,396 | A * | 9/1993 | Castelli et al. | 399/167 |
| 7,177,552 | B2 | 2/2007 | Koike | |
| 2004/0127317 | A1* | 7/2004 | Takuroh et al. | 474/117 |
| 2006/0140685 | A1* | 6/2006 | Muroi | 399/301 |

FOREIGN PATENT DOCUMENTS

| | | |
|---|---|---|
| JP | 10-228150 | 8/1998 |
| JP | 11-052757 | 2/1999 |
| JP | 2004-004573 | 1/2004 |
| JP | 2005-031161 | 2/2005 |
| JP | 2005-106918 | 4/2005 |
| JP | 2005-164678 | 6/2005 |

* cited by examiner

*Primary Examiner* — David Gray
*Assistant Examiner* — Roy Yi
(74) *Attorney, Agent, or Firm* — IPUSA, PLLC

(57) ABSTRACT

In an image forming device including a first rotary member arranged to drive an intermediate transfer belt, a first motor arranged to rotate the first rotary member, and a second rotary member arranged to transfer a toner image formed on the intermediate transfer belt to a recording sheet, a torque command value detecting unit detects a torque command value to the first motor. A setting unit sets up a lower limit of the torque command value. A judgment unit determines whether a detected torque command value exceeds the lower limit. A control unit controls driving of the second rotary member when the detected torque command value exceeds the lower limits so that a difference between a surface speed of the intermediate transfer belt and a peripheral speed of the second rotary member falls within a predetermined range.

16 Claims, 24 Drawing Sheets

IMAGE FORMING DEVICE ADAPTED TO CONTROL SPEED DIFFERENCE BETWEEN FIRST ROTARY MEMBER AND SECOND ROTARY MEMBER

BACKGROUND OF THE INVENTION

1. Field of the Invention

This invention relates to an image forming device which includes an intermediate transfer drive motor which rotates an intermediate transfer belt, and a secondary transfer motor which rotates a secondary transfer roller, and relates to a semiconductor device for use in an image forming device.

2. Description of the Related Art

In an image forming device, when a toner image, primarily transferred from a photoconductor drum to an intermediate transfer belt, is secondarily transferred to a recording sheet, the toner image on the intermediate transfer belt is transferred to the recording sheet by nipping the recording sheet between the intermediate transfer belt and a secondary transfer roller which are pressed against each other.

FIG. 1 shows a secondary transfer roller and an intermediate transfer belt in an image forming device. The image forming device 10 shown in FIG. 1 includes a secondary transfer roller 11, an intermediate transfer driving roller 12, a repulsive-force roller 13, an intermediate transfer belt 14, and an intermediate transfer drive motor 15.

The intermediate transfer driving roller 12 is a roller which drives the intermediate transfer belt 14, and the intermediate transfer drive motor 15 is a motor which rotates the intermediate transfer driving roller 12.

The secondary transfer roller 11 is a roller for transferring a toner image from the intermediate transfer belt 14 to a recording sheet.

The intermediate transfer belt 14 is supported by the intermediate transfer driving roller 12, the repulsive-force roller 13, and other rollers. The intermediate transfer belt 14 is driven in the direction, indicated by the arrow 16 in FIG. 1, when the intermediate transfer driving roller 12 is rotated by the intermediate transfer drive motor 15.

In the image forming device 10, the secondary transfer roller 11 and the repulsive-force roller 13, arranged in the position facing the secondary transfer roller 11, are pressed against each other, so that the intermediate transfer belt 14, supported by the repulsive-force roller 13 and the secondary transfer roller 11 are pressed against each other to nip a recording sheet 17 between them during transport.

The toner image primarily transferred from the photoconductor drum 18 to the intermediate transfer belt 14 is secondarily transferred to the recording sheet 17 when the recording sheet 17 is nipped between the secondary transfer roller 11 and the intermediate transfer belt 14 which are pressed against each other.

In order to prevent a positional deviation of a reproduced image, it is necessary that a peripheral speed of the secondary transfer roller 11 and a surface speed of the intermediate transfer belt 14 when transferring a toner image to the recording sheet 17 are in agreement with good accuracy.

However, the surface speed of the intermediate transfer belt 14 in the image forming device 10 shown in FIG. 1 may be changed by the influences of various neighboring mechanisms, such as rollers for supporting photoconductor drums 18 and rollers for supporting the recording sheet 17.

Moreover, the peripheral speed of the secondary transfer roller 11 may be changed in accordance with other factors, such as thermal expansion of the rollers at ambient temperature. If a speed difference between the peripheral speed of the secondary transfer roller 11 and the surface speed of the intermediate transfer belt 14 arises, the toner image on the intermediate transfer belt 14 is not correctly transferred to the recording sheet 17, which causes deterioration of the quality of a reproduced image, such as a color deviation.

In order to eliminate the speed difference, Japanese Laid-Open Patent Application No. 11-052757 discloses a color image forming device which uses a torque limiter to reduce fluctuations of the intermediate transfer belt speed and prevent the toner image formation positions from deviating from each other.

The torque limiter in the above-mentioned image forming device as disclosed in Japanese Laid-Open Patent Application No. 11-052757 is a mechanical part, and the life thereof is restricted. Installing the torque limiter in the image forming device also causes the cost to increase.

SUMMARY OF THE INVENTION

In one aspect of the invention, the present disclosure provides an improved image forming device in which the above-described problems are eliminated.

In one aspect of the invention, the present disclosure provides an image forming device which carries out an appropriate speed control to eliminate speed fluctuations of the peripheral speed of a secondary transfer roller and the surface speed of an intermediate transfer belt without increasing the number of component parts and the cost.

In an embodiment of the invention which solves or reduces one or more of the above-mentioned problems, the present disclosure provides an image forming device including a first rotary member arranged to drive an intermediate transfer belt, a first motor arranged to rotate the first rotary member, and a second rotary member arranged to transfer a toner image formed on the intermediate transfer belt to a recording sheet, the image forming device comprising: a torque command value detecting unit configured to detect a torque command value to the first motor; a setting unit configured to set up a lower limit of the torque command value; a judgment unit configured to determine whether a torque command value detected by the torque command value detecting unit exceeds the lower limit; and a control unit configured to control driving of the second rotary member when the detected torque command value exceeds the lower limit, so that a difference between a surface speed of the intermediate transfer belt and a peripheral speed of the second rotary member falls within a predetermined range.

The above-mentioned image forming device may be arranged so that the setting unit is configured to set up an upper limit of the torque command value, and the judgment unit is configured to determine whether a torque command value detected by the torque command value detecting unit exceeds the upper limit.

The above-mentioned image forming device may be arranged to further comprise a PWM (pulse width modulation) control unit configured to control the first motor, wherein the torque command value detecting unit is configured to detect a current command value supplied to the PWM control unit as being a torque command value, and the judgment unit is configured to determine whether the current command value exceeds either the upper limit or the lower limit.

The above-mentioned image forming device may be arranged so that the setting unit is configured to set up a first lower limit and a second lower limit of the current command value, and the judgment unit is configured to determine whether a current command value detected by the torque command value detecting unit exceeds the first lower limit and the second lower limit within a predetermined time.

The above-mentioned image forming device may be arranged so that the torque command value detecting unit is configured to detect a lower limit of the current command value based on a detected current command value, the setting unit is configured to set up a value which is produced by adding a predetermined tolerance to the lower limit detected by the torque command value detecting unit, and the judgment unit is configured to determine whether a current command value detected by the torque command value detecting unit is smaller than the value which is produced by adding the predetermined tolerance to the lower limit.

The above-mentioned image forming device may be arranged to further comprise: a PWM control unit configured to control the first motor; a rotational speed detecting unit configured to detect a rotational speed of the first motor; and a current value computing unit configured to compute a current value of the first motor based on a current command value supplied to the PWM control unit and a rotational speed detected by the rotational speed detecting unit, wherein the torque command value detecting unit is configured to detect a current value computed by the current value computing unit as being the torque command value.

The above-mentioned image forming device may be arranged to further comprise a current value detecting unit configured to detect a current value of the first motor, wherein the torque command value detecting unit is configured to detect a current value detected by the current value detecting unit as being the torque command value.

The above-mentioned image forming device may be arranged so that the control unit comprises a speed control unit configured to control a speed of the second rotary member so that a difference between the surface speed of the intermediate transfer belt and the peripheral speed of the second rotary member falls within the predetermined range.

The above-mentioned image forming device may be arranged so that the speed control unit comprises: a target value storing unit configured to store a plurality of target values with respect to a rotational speed of the second rotary member; a target value selecting unit configured to select a target value from among the plurality of target values stored in the target value storing unit; and a speed command outputting unit configured to output the target value selected by the target value selecting unit as being a speed command value.

The above-mentioned image forming device may be arranged so that the target value selecting unit is configured to select a target value which causes a difference between the peripheral speed of the second rotary member and the surface speed of the intermediate transfer belt to fall within the predetermined range.

The above-mentioned image forming device may be arranged so that the target value selecting unit is configured to select a target value which minimizes a difference between the peripheral speed of the second rotary member and the surface speed of the intermediate transfer belt.

The above-mentioned image forming device may be arranged so that the control unit comprises a current limiting unit configured to limit a current value of the second rotary member so that a difference between the surface speed of the intermediate transfer belt and the peripheral speed of the second rotary member falls within the predetermined range.

The above-mentioned image forming device may be arranged so that the current limiting unit comprises a current-limiting value setting unit configured to set up a current-limiting value of the second rotary member, and the current-limiting value setting unit is configured to set up a current-limiting value which causes the difference between the surface speed of the intermediate transfer belt and the peripheral speed of the second rotary member to fall within the predetermined range.

In an embodiment of the invention which solves or reduces one or more of the above-mentioned problems, the present disclosure provides a semiconductor device for use in an image forming device including a first rotary member arranged to drive an intermediate transfer belt, a first motor arranged to rotate the first rotary member, and a second rotary member arranged to transfer a toner image formed on the intermediate transfer belt to a recording sheet, the semiconductor device comprising: a torque command value detecting unit configured to detect a torque command value to the first motor; a setting unit configured to set up a lower limit of the torque command value; a judgment unit configured to determine whether a torque command value detected by the torque command value detecting unit exceeds the lower limit; and a control unit configured to control driving of the second rotary member when the detected torque command value exceeds the lower limit, so that a difference between a surface speed of the intermediate transfer belt and a peripheral speed of the second rotary member falls within a predetermined range.

It is possible that the image forming device of the invention carries out an appropriate speed control to eliminate speed fluctuations of the peripheral speed of the secondary transfer roller and the surface speed of the intermediate transfer belt without increasing the number of component parts and the cost.

Other objects, features and advantages of the present invention will become more apparent from the following detailed description when read in conjunction with the accompanying drawings.

DETAILED DESCRIPTION OF THE PREFERRED EMBODIMENTS

Before describing embodiments of the invention, the principle of the invention will be explained in order to facilitate understanding of the invention.

An image forming device according to the invention is arranged to detect a torque command value to an intermediate transfer drive motor and control the peripheral speed of a secondary transfer roller based on a detection result of the torque command value. It is possible to carry out an appropriate speed control to eliminate speed fluctuations of the peripheral speed of the secondary transfer roller and the surface speed of the intermediate transfer belt at a location where the intermediate transfer belt and the secondary transfer roller are pressed on each other. It is possible to keep the peripheral speed of the secondary transfer roller and the surface speed of the intermediate transfer belt in agreement with good accuracy.

Figure 1:
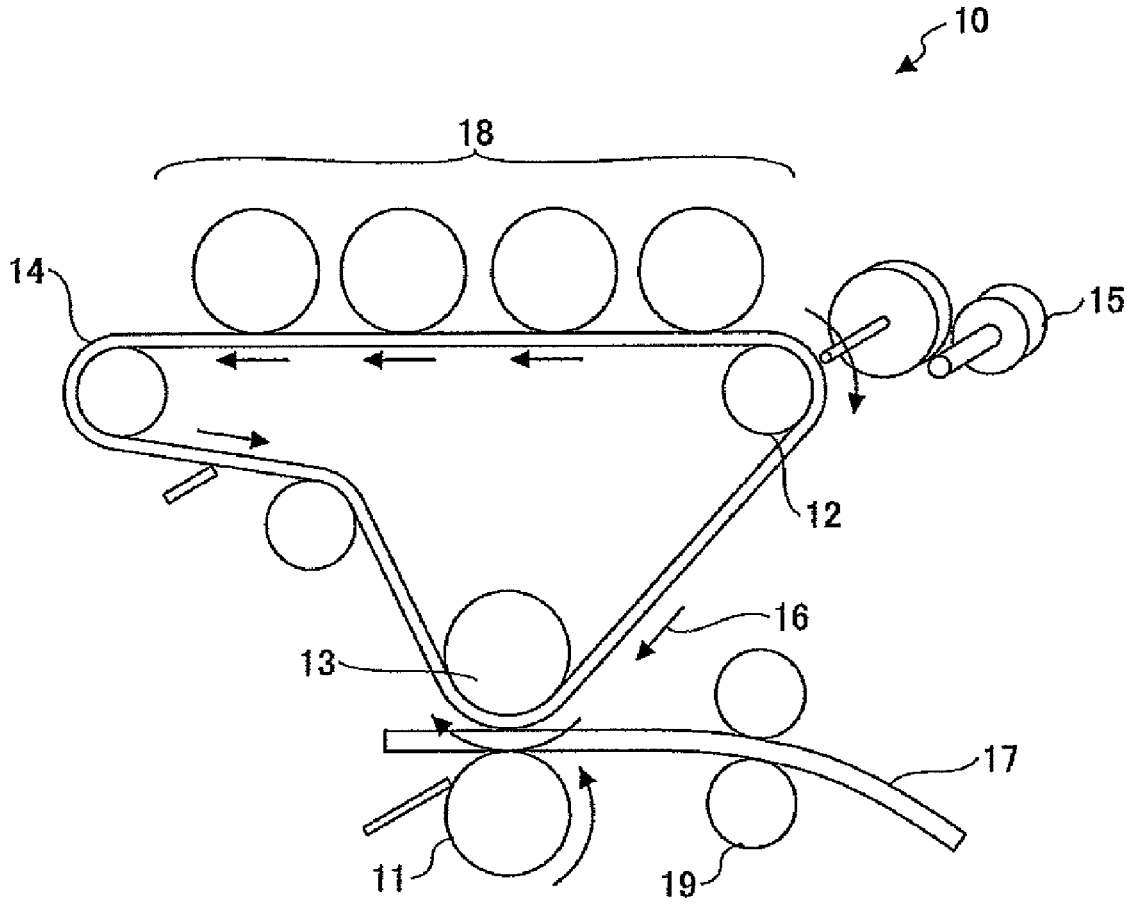
FIG. 1 is a diagram showing a secondary transfer roller and an intermediate transfer belt in an image forming device.
Figure 2:
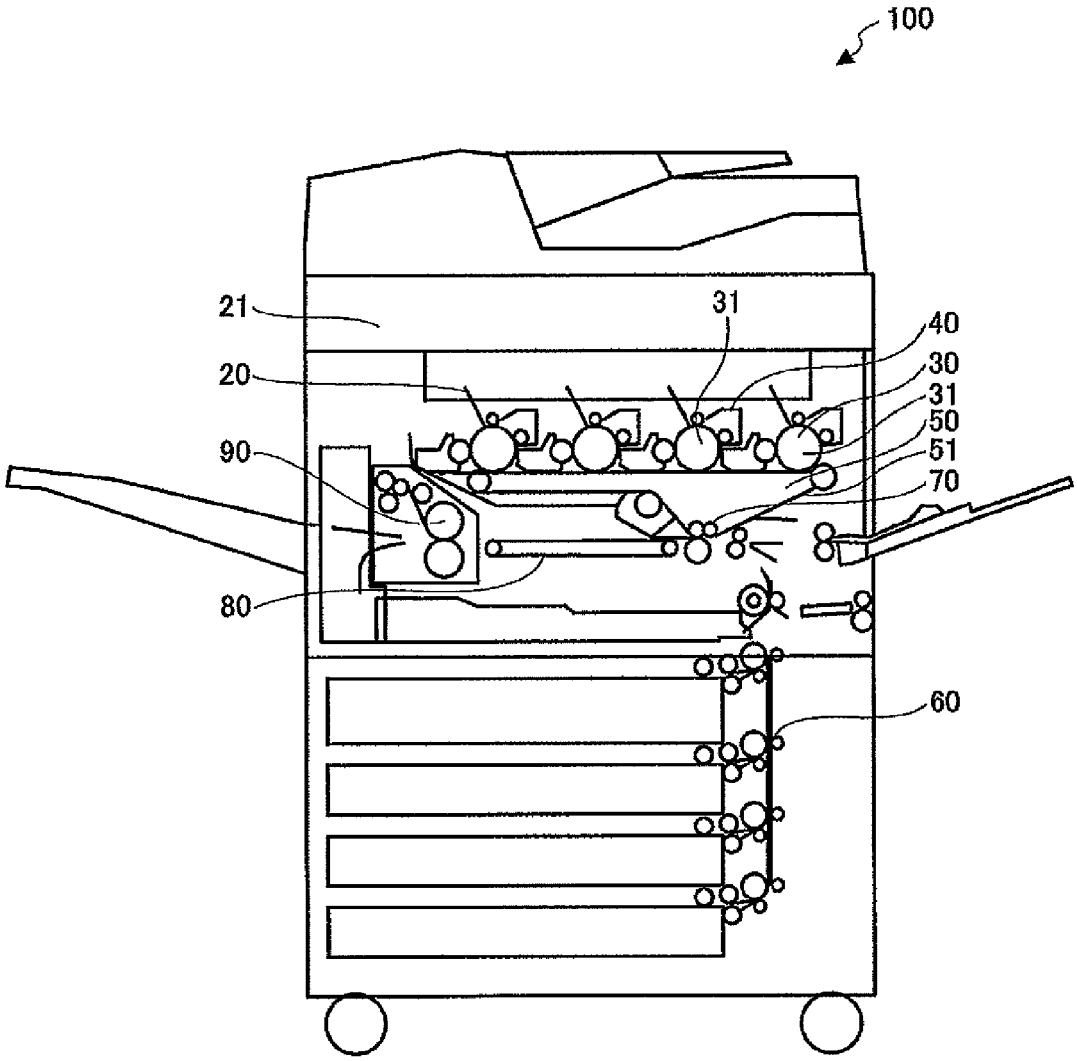
FIG. 2 is a diagram showing the outline of an image forming device.

A description will be given of the composition of an image forming device 100 of the invention. FIG. 2 shows the outline of the image forming device 100 of the invention.

In the image forming device 100, a document is scanned by a scanner unit 21 while the document is irradiated by light from the light source of the scanner unit 21, and an image is read by a three-line CCD (charge coupled device) sensor based on a reflected light from the document.

The read image is subjected to several image processes, such as scanner gamma correction, color conversion, image separation, and gray-level correction processes, by an image processing unit, and it is transferred to an image writing unit 20.

In the image writing unit 20, the driving of a LD (laser diode) is modulated in accordance with image data. In a photoconductor unit 30, an electrostatic latent image is optically written to a photoconductor drum 31 which is rotated and charged uniformly, by using a laser beam emitted by the LD. A development unit 40 supplies toner to the electrostatic latent image so that a toner image is visualized.

The toner image formed on the photoconductor drum is transferred to an intermediate transfer belt 51 of an intermediate transfer unit 50. When a full-color copy is formed by the image forming device 100, the toner images of four colors (black, cyan, magenta, yellow) are sequentially transferred to the intermediate transfer belt 51 and the images are laminated.

After the imaging and transferring of all the colors are completed, a recording sheet from a paper tray 60 is supplied at a timing in accordance with rotation of the intermediate transfer belt 51, and the toner images of the four colors are transferred from the intermediate transfer belt 51 to the recording sheet by the secondary transfer unit 70 simultaneously.

The recording sheet to which the toner images are transferred is transported to a fixing unit 90 through a transport unit 80. The toner images are fixed to the recording sheet by a fixing roller and a pressurizing roller of the fixing unit 90, and then the recording sheet is ejected to the outside of the image forming device 100.

Figure 3:
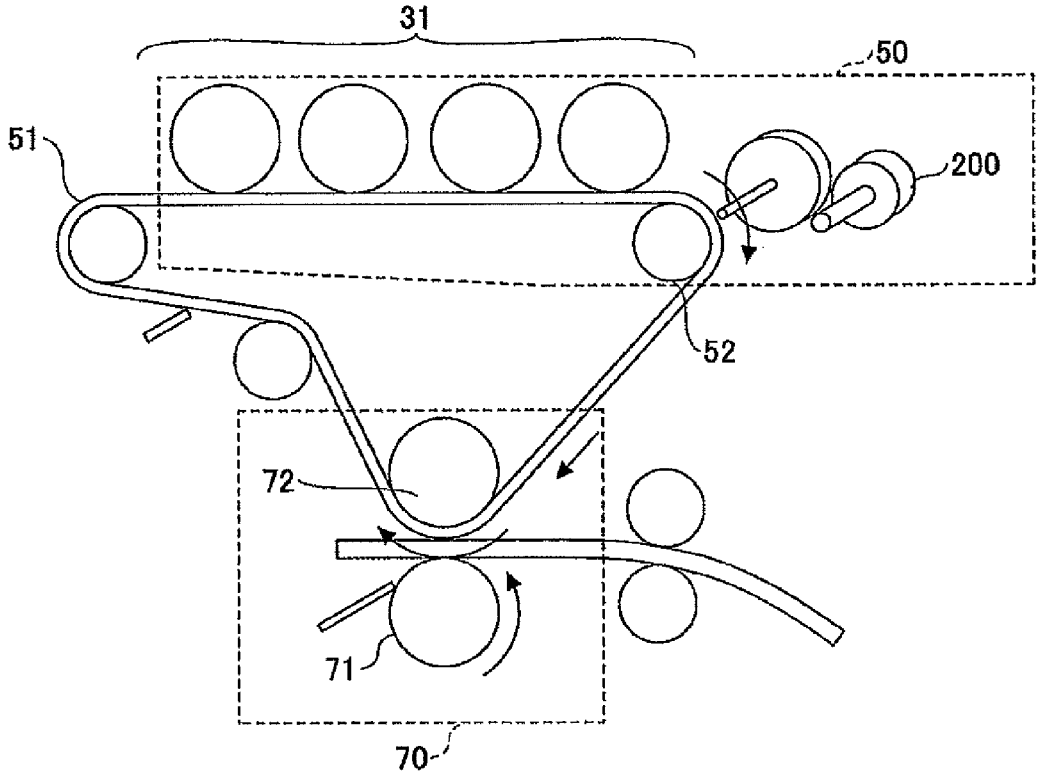
FIG. 3 is a diagram showing the composition of an intermediate transfer belt and a mechanism for driving the intermediate transfer belt in an image forming device.

FIG. 3 shows the composition of an intermediate transfer belt 51 and a mechanism for driving the intermediate transfer belt 51 in the image forming device 100.

In the image forming device 100 shown in FIG. 3, an intermediate transfer driving roller 52 is a first rotary member which drives the intermediate transfer belt 51, and an intermediate transfer drive motor 200 is a first motor which rotates the intermediate transfer driving roller 52. A secondary transfer roller 71 is a second rotary member which is arranged to secondarily transfer a toner image from the intermediate transfer belt 51 to a recording sheet.

The image forming device 100 causes the intermediate transfer drive motor 200 to rotate the intermediate transfer driving roller 52, so that the intermediate transfer belt 51 is driven by the intermediate transfer driving roller 52. The toner image formed on the intermediate transfer belt 51 is conveyed to a location of the nip portion between the intermediate transfer belt 51 and the secondary transfer roller 71. The conveyed toner image is transferred from the intermediate transfer belt 51 to a recording sheet by actuating a repulsive-force roller 72 to press the intermediate transfer belt 51 to the secondary transfer roller 71 to nip the recording sheet at the location of the nip portion of the intermediate transfer belt 51 and the secondary transfer roller 71.

Figure 4:
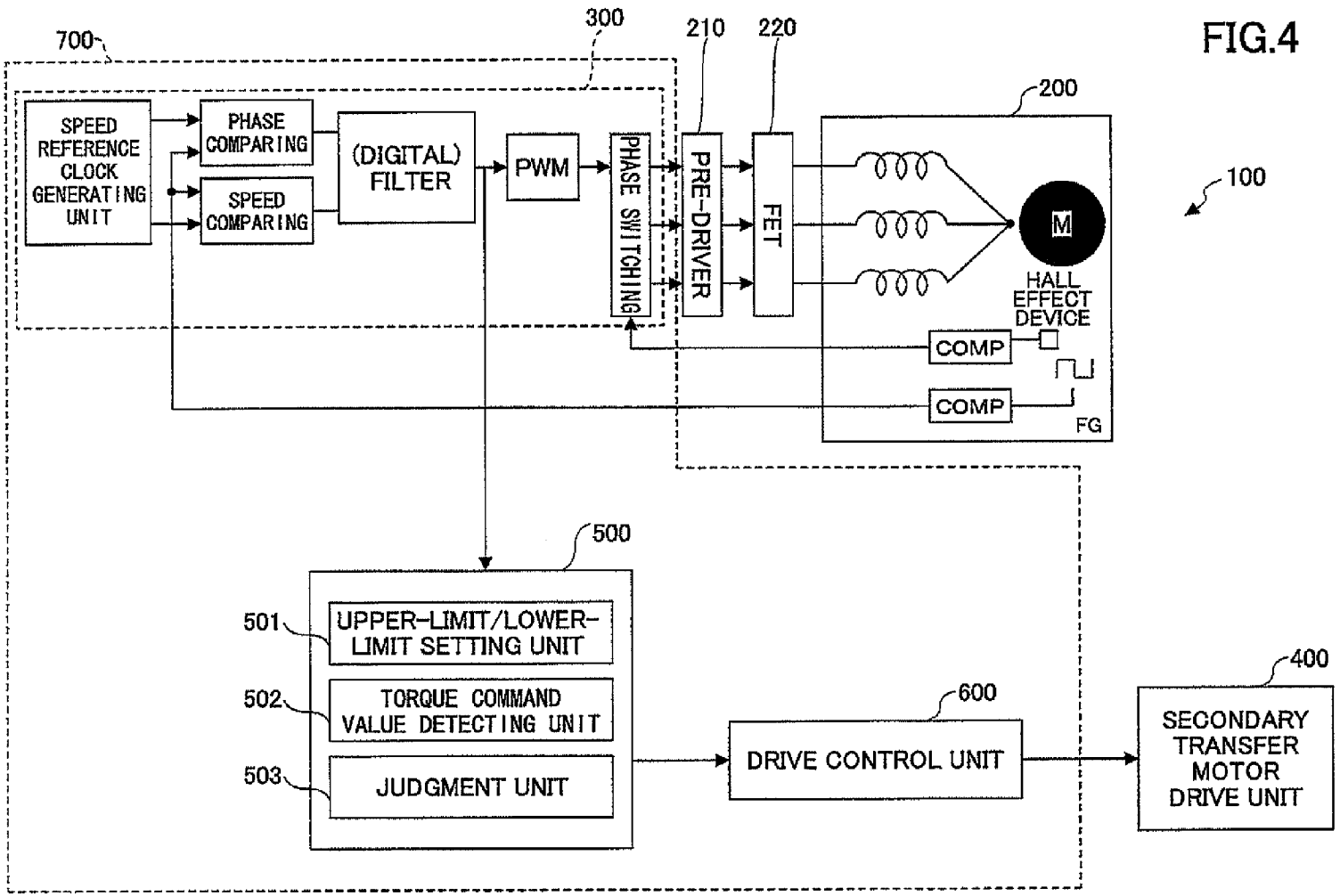
FIG. 4 is a block diagram showing the composition of an image forming device.

FIG. 4 shows the composition of an image forming device 100 of the invention.

As shown in FIG. 4, the image forming device 100 includes an intermediate transfer drive motor 200, a pre-driver 210, a FET (field effect transistor) 220, an intermediate transfer drive motor driving unit 300, a secondary transfer motor drive unit 400, an output monitoring unit 500, and a drive control unit 600.

The intermediate transfer drive motor 200 rotates an intermediate transfer driving roller 52 which drives an intermediate transfer belt 51. The intermediate transfer drive motor driving unit 300 controls the driving of the intermediate transfer drive motor 200. The intermediate transfer drive motor driving unit 300 in the image forming device 100 of this embodiment controls the intermediate transfer drive motor 200 so that the surface speed of the intermediate transfer belt is held at a fixed speed.

The pre-driver 210 and the FET 220 amplify an output signal from the intermediate transfer drive motor driving unit 300 and transmit the amplified signal to the intermediate transfer drive motor 200.

The secondary transfer motor drive unit 400 controls the driving of a secondary transfer motor (not shown) which rotates the secondary transfer roller 71. The output monitoring unit 500 monitors a torque command value to the intermediate transfer drive motor 200. The drive control unit 600 controls the driving of the secondary transfer motor drive unit 400 based on a detection result of the output monitoring unit 500.

The output monitoring unit 500 in the image forming device 100 includes a low-limit setting unit 501, a torque command value detecting unit 502, and a judgment unit 503.

The low-limit setting unit 501 sets up a lower limit of a torque command value. The torque command value detecting unit 502 detects a PWM value in the intermediate transfer drive motor driving unit 300 as a torque command value. The judgment unit 503 determines whether a PWM value detected by the torque command value detecting unit 502 exceeds a lower limit set by the low-limit setting unit 510. The details of the lower limit and the intermediate transfer drive motor drive 300 will be described later.

The drive control unit 600 outputs a signal (driving control signal) for controlling the driving of the secondary transfer roller 71 to the secondary transfer motor drive unit 400 based on a result of determination by the output monitoring unit 500. The secondary transfer motor drive unit 400 controls a torque command value to the secondary transfer motor which rotates the secondary transfer roller 71, in response to a driving control signal received from the drive control unit 600. The secondary transfer motor drive unit 400 controls the torque command value to bring the peripheral speed of the secondary transfer roller 71 close to the surface speed of the intermediate transfer belt 51.

In the image forming device 100 of the invention, a tolerance of a speed difference between the peripheral speed of the secondary transfer roller 71 and the surface speed of the intermediate transfer belt 51 is set up, and the driving of the secondary transfer roller 71 is controlled so that the speed difference falls within the tolerance.

In the following, the speed difference between the peripheral speed of the secondary transfer roller 71 and the surface speed of the intermediate transfer belt 51 will be called a relative speed of secondary transfer roller 71 to the surface speed of intermediate transfer belt 51. The tolerance of the speed difference will be called a relative-speed tolerance.

In the image forming device 100 of the invention, the relative speed of the secondary transfer roller 71 is controlled to approach 0. Therefore, a positional deviation in transferring a toner image to a recording sheet can be made small and the quality of a reproduced image can be raised.

In the image forming device 100 of the invention, the intermediate transfer drive motor driving unit 300, the output monitoring unit 500, and the drive control unit 600 may be integrated into a semiconductor device 700. Alternatively, either the intermediate transfer drive motor driving unit 300 and the output monitoring unit 500 or the output monitoring unit 500 and the drive control unit 600 may be integrated into a semiconductor device 700. Alternatively, either the secondary transfer motor drive unit 400, the output monitoring unit 500 and the drive control unit 600 or the secondary transfer motor drive unit 400 and the drive control unit 600 may be integrated into a semiconductor device 700. The semiconductor device 700 may be mounted in the image forming device 100 to carry out the functions of any of the above-mentioned units 300, 400, 500, and 600.

Next, a description will be given of an image forming device of an embodiment of the invention.

In the image forming device 100 of the invention, the drive control by the drive control unit 600 is performed by one of the following two methods. The first method is to control a rotational speed of the secondary transfer roller 71. The second method is to control a limiting value (current-limiting value) of the current supplied to the secondary transfer roller.

Among the following embodiments of the invention, the first to fifth embodiments are arranged to perform the drive control by using the first method of controlling a rotational speed of the secondary transfer roller 71. The sixth embodiment is arranged to perform the drive control by using the second method of controlling the current-limiting value supplied to the secondary transfer roller 71.

Figure 5:
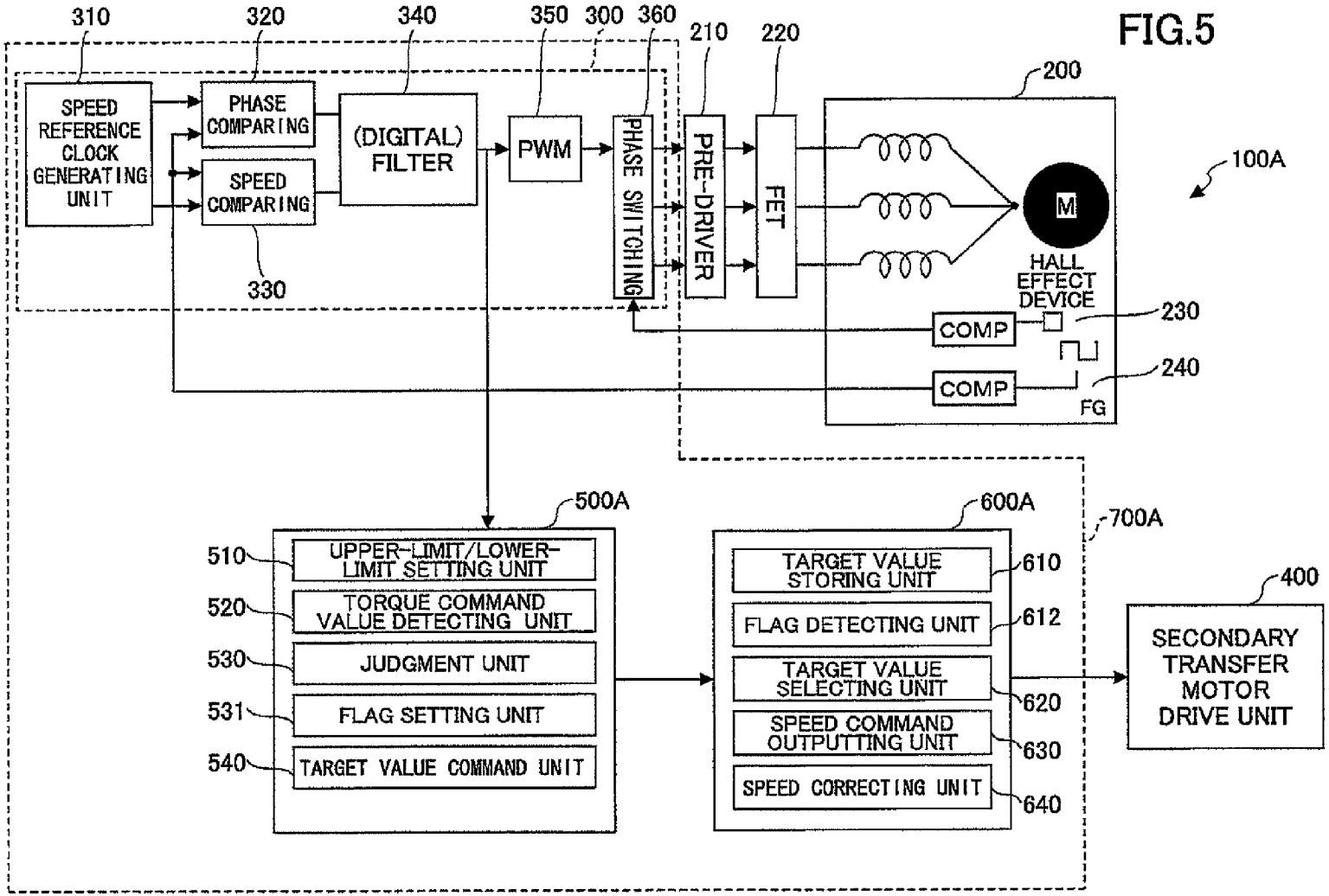
FIG. 5 is a block diagram showing the composition of an image forming device of a first embodiment of the invention.

Next, the first embodiment of the invention will be explained. FIG. 5 shows the composition of an image forming device 100A of the first embodiment of the invention.

As shown in FIG. 5, the image forming device 100A of this embodiment includes an intermediate transfer drive motor 200, a pre-driver 210, an FET (field effect transistor) 220, an intermediate transfer drive motor driving unit 300, a secondary transfer motor drive unit 400, an output monitoring unit 500A, and a speed control unit 600A.

The intermediate transfer drive motor 200 includes a Hall effect device 230 and a frequency generator (FG) 240. The Hall effect device 230 detects the angle of rotation of the intermediate transfer drive motor 200 and outputs the detection result as a Hall signal. The FG 240 detects the rotational speed of the intermediate transfer drive motor 200.

The intermediate transfer drive motor driving unit 300 includes a speed reference clock generating unit 310, a phase comparing unit 320, a speed comparing unit 330, a digital filter 340, a PWM unit 350, and a phase switching unit 360.

The speed reference clock generating unit 310 generates a speed reference clock for giving a speed command, in response to a received speed command value. The phase comparing unit 320 compares the phase of the rotational speed detected by the FG 240 and the phase of the clock generated by the speed reference clock generating unit 210. The speed comparing unit 330 compares the rotational speed detected by the FG 240 and the clock generated by the speed reference clock generating unit 210.

The digital filter 340 performs addition and smoothing of the comparison output from the phase comparing unit 320 and the comparison result from the speed comparing unit 330, and outputs the resulting signal to the PWM unit 350 as a PWM value. The PWM unit 350 converts the output of the digital filter 340 into a PWM signal and outputs the PWM signal to the phase switching unit 360. This PWM value indicates a current command value to determine the on-duty of the PWM signal-output from the PWM unit 350.

The phase switching unit 360 performs switching of the phase of the intermediate transfer drive motor 200 based on the PWM signal output from the PWM unit 350 and the Hall signal from the Hall effect device 230.

The secondary transfer motor drive unit 400 has the composition that is essentially the same as that of the intermediate transfer drive motor driving unit 300. Specifically, the secondary transfer motor drive unit 400 in this embodiment includes a speed reference clock generating unit, a phase comparing unit, a speed comparing unit, a digital filter, a PWM unit, and a phase switching unit, which are not illustrated in FIG. 5. The secondary transfer motor drive unit 400 controls a rotational speed of the secondary transfer roller 71 based on the speed reference clock generated by the speed reference clock generating unit.

The output monitoring unit 500A includes an upper-limit/lower-limit setting unit 510, a torque command value detecting unit 520, a judgment unit 530, a flag setting unit 531, and a target value command unit 540.

The upper-limit/lower-limit setting unit 510 sets up an upper limit and a lower limit of a torque command value. The details of the upper limit and the lower limit of the torque command value will be mentioned later.

The torque command value detecting unit 520 detects a torque command value which is output to the intermediate transfer drive motor 200 from the intermediate transfer drive motor driving unit 300. The torque command value detecting unit 520 in this embodiment detects a PWM value output from the digital filter 340 as being a torque command value. The torque command value detecting unit 520 detects a PWM value periodically at intervals of a predetermined period which is set up beforehand.

The judgment unit 530 determines whether the PWM value detected by the torque command value detecting unit 520 exceeds the upper limit or lower limit set by the upper-limit/lower-limit setting unit 510. The judgment unit 530 in this embodiment determines that the PWM value has exceeded the upper limit, when the PWM value is larger than the upper limit. The judgment unit 530 in this embodiment determines that the PWM value has dropped below the lower limit, when the PWM value is smaller than the lower limit.

The flag setting unit 531 sets a flag which indicates that speed control should be performed, to the speed control unit 600A, when the PWM value detected by the torque command value detecting unit 520 has exceeded the upper limit or dropped below the lower limit.

The target value command unit 540 outputs the command to increase the rotational speed of the secondary transfer roller 71, to the speed control unit 600A, when it is determined by the judgment unit 530 that the PWM value has exceeded the upper limit. The target value command unit 540 outputs the command to decrease the rotational speed of the secondary transfer roller 71, to the speed control unit 600A, when it is determined by the judgment unit 530 that the PWM value has dropped below the lower limit.

The speed control unit 600A includes a target value storing unit 610, a flag detecting unit 612, a target value selecting unit 620, a speed command outputting unit 630, and a speed correcting unit 640.

In the target value storing unit 610, two or more target values for controlling the speed of the secondary transfer roller 71 are stored. A target value in this embodiment means a speed command value for controlling the secondary transfer motor which rotates the secondary transfer roller 71. The details of the target value will be described later. The flag detecting unit 612 detects whether the speed control flag is set.

The target value selecting unit 620 chooses a target value for increasing the rotational speed of the secondary transfer roller 71 or a target value for decreasing the rotational speed of the secondary transfer roller 71 from among the target values stored in the target value storing unit 610, in accordance with the command received from the target value command unit 540 of the output monitoring unit 500A.

The speed command outputting unit 630 outputs the target value chosen by the target value selecting unit 620, to the secondary transfer motor drive unit 400. The speed correcting unit 640 performs speed correction in accordance with the temperature characteristics of the secondary transfer roller 71. The details of speed correction will be described later.

Next, the upper limit and the lower limit of the torque command value stored in the upper-limit/lower-limit setting unit 510 will be explained.

The upper limit and the lower limit of the torque command value, which are set by the upper-limit/lower-limit setting unit 510 in this embodiment, are determined beforehand based on experimental data. For example, the upper limit and the lower limit of the torque command value may be set up beforehand in the upper-limit/lower-limit setting unit 510 at the time of shipment of the image forming device 100A.

Figure 6:
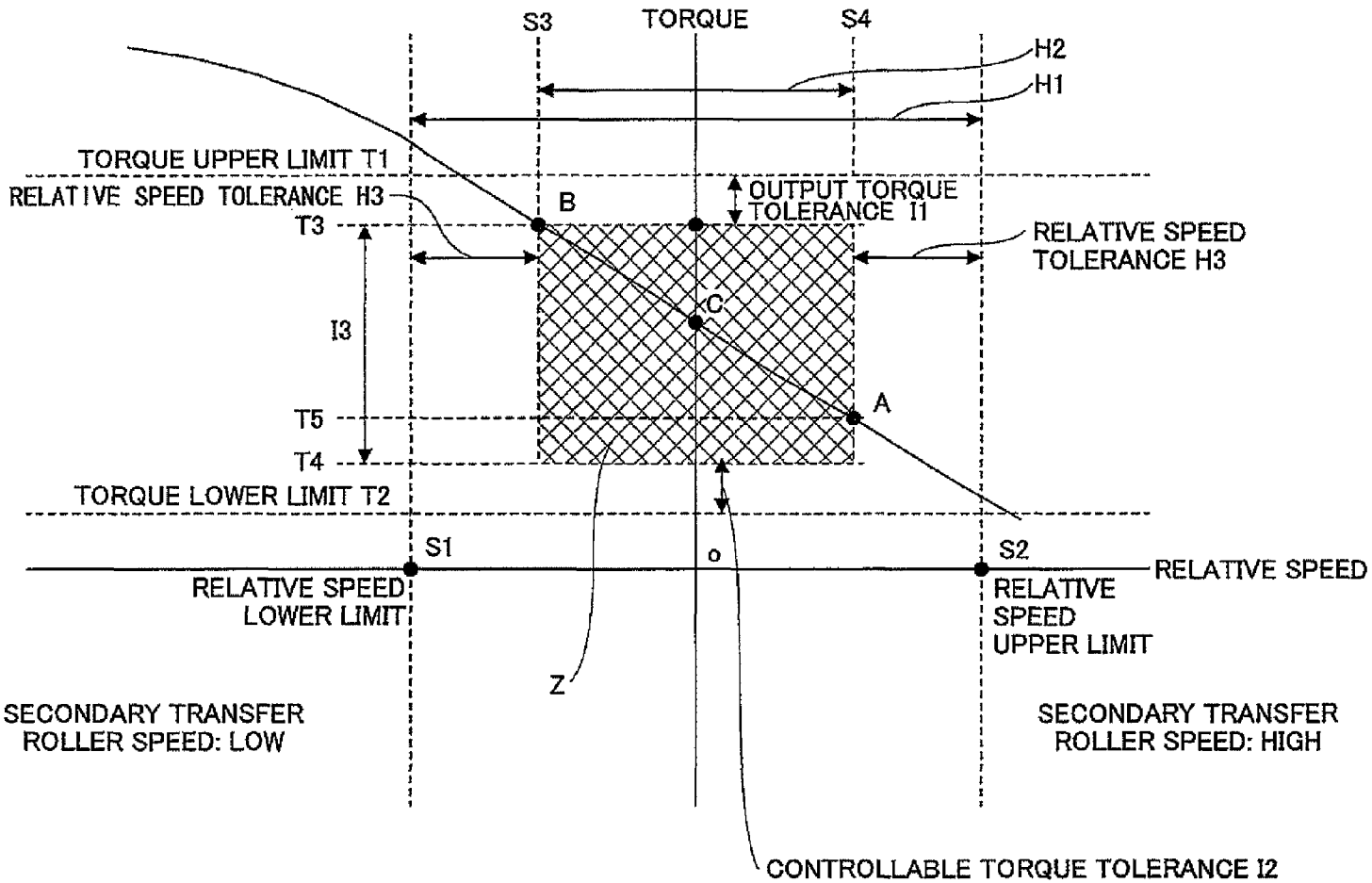
FIG. 6 is a diagram for explaining the relationship between a torque on the shaft of an intermediate transfer driving roller and a relative speed of a secondary transfer roller to a surface speed of an intermediate transfer belt.

FIG. 6 is a diagram for explaining the relationship between a torque on the shaft of the intermediate transfer driving roller and a relative speed of the secondary transfer roller 71 to a surface speed of the intermediate transfer belt 51.

In FIG. 6, the vertical axis represents the torque and the horizontal axis represents the relative speed.

A relative-speed tolerance H2 in this embodiment will be explained. In this embodiment, a relative-speed tolerance H2 is set up, and the rotational speed of the secondary transfer roller 71 is controlled so that the relative speed falls within the relative-speed tolerance H2. This makes it possible to carry out an appropriate speed control to eliminate speed fluctuations of the peripheral speed of the secondary transfer roller 71 and the surface speed of the intermediate transfer belt 51.

This relative-speed tolerance H2 is a range which is produced by subtracting a tolerance H3 from a relative-speed range H1 which is determined depending on the image quality. For example, the image quality may be determined based on the results of comparison between the image output by the image forming device 100A and the image with a fixed image quality specified in accordance with the standard requirements, and the relative-speed range H1 may be determined depending on the determined image quality.

In the relationship of FIG. 6, S1 denotes a relative speed lower limit determined depending on the image quality, and S2 denotes a relative speed upper limit determined depending on the image quality. The relative-speed range H1 is equivalent to a range between the relative speed lower limit S1 and the relative speed upper limit S2. A relative speed S3 is produced by adding the tolerance H3 to the relative speed lower limit S1, and a relative speed S4 is produced by subtracting the tolerance H3 from the relative speed upper limit S2. Therefore, the relative-speed tolerance H2 is equivalent to a range between the relative speed S3 and the relative speed S4.

It is preferred that the relative-speed range H1 is set to about 0.5% of the peripheral speed of the secondary transfer roller 71 and the surface speed of the intermediate transfer belt 51.

It is preferred that the relative-speed tolerance H2 and the tolerance H3 are set up so that the relative-speed tolerance H2 is set to about 0.4% of the peripheral speed of secondary transfer roller 71 and the surface speed of intermediate transfer belt 51.

Next, the upper limit and the lower limit of the torque command value in this embodiment will be explained.

A torque upper limit T1 shown in FIG. 6 is determined depending on the maximum output torque of the intermediate transfer drive motor 200. A torque lower limit T2 is determined depending on the control performance of the intermediate transfer drive motor driving unit 300. In this embodiment, a tolerance is given to each of the torque upper limit T1 and the torque lower limit T2, respectively. Specifically, an output torque tolerance I1 is subtracted from the torque upper limit T1 to produce a torque T3, and a controllable tolerance I2 is added to the torque lower limit T2 to produce a torque T4. Therefore, in this embodiment, a torque variable range I3 is a range between the torque T3 and the torque T4.

The image forming device 100A of this embodiment controls the peripheral speed of the secondary transfer roller 71 and thereby controls the relative speed, so that the operating point falls within a region Z which is determined by both the relative-speed tolerance H2 and the torque variable range I3 as indicated in FIG. 6.

Therefore, the upper-limit/lower-limit setting unit 510 in this embodiment sets up the upper limit and the lower limit of a torque command value based on a torque which falls within the region Z.

The upper limit of the torque command value set by the upper-limit/lower-limit setting unit 510 according to the relationship between the torque and relative speed in the image forming device 100A of this embodiment is equivalent a torque command value (PWM value) based on the torque T3 at the operating point B indicated in FIG. 6. Similarly, the lower limit of the torque command value set by the upper-limit/lower-limit setting unit 510 is equivalent to a torque command value (PWM value) based on the torque T5 at the operating point A indicated in FIG. 6.

Next, the target values stored in the target value storing unit 610 of the speed control unit 600A will be explained.

In the image forming device 100A of this embodiment, the secondary transfer motor drive unit 400 is caused to control the torque of the secondary transfer motor, thereby changing the rotational speed of the secondary transfer roller 71, so that the peripheral speed of the secondary transfer roller 71 is controlled.

Each of the target values stored in the target value storing unit 610 is a speed command value for changing the rotational speed of the secondary transfer roller 71. Specifically, the speed command value in this embodiment is a speed command value for changing the period of a speed reference clock generated by the speed reference clock generating unit included in the secondary transfer motor drive unit 400.

Two or more target values are stored in the target value storing unit 610. For examples the target values stored may include a target value which decreases a rotational speed of the secondary transfer roller 71 at a certain time by 0.10%, a target value which decreases a rotational speed of the secondary transfer roller 71 at a certain time by 0.05%, a target value which increases a rotational speed of the secondary transfer roller 71 at a certain time by 0.05%, a target value which increases a rotational speed of the secondary transfer roller 71 at a certain time by 0.10%, etc.

The target values stored in the target value storing unit 610 in this embodiment are not limited to the target values which change the rotational speed of the secondary transfer roller 71 by increments or decrements of 0.05%, and may include target values which change the rotational speed of the secondary transfer roller 71 at intervals of a predetermined amount.

Next, the operation of the image forming device 100A of this embodiment will be explained with reference to FIGS. 7 to 9.

Figure 7:
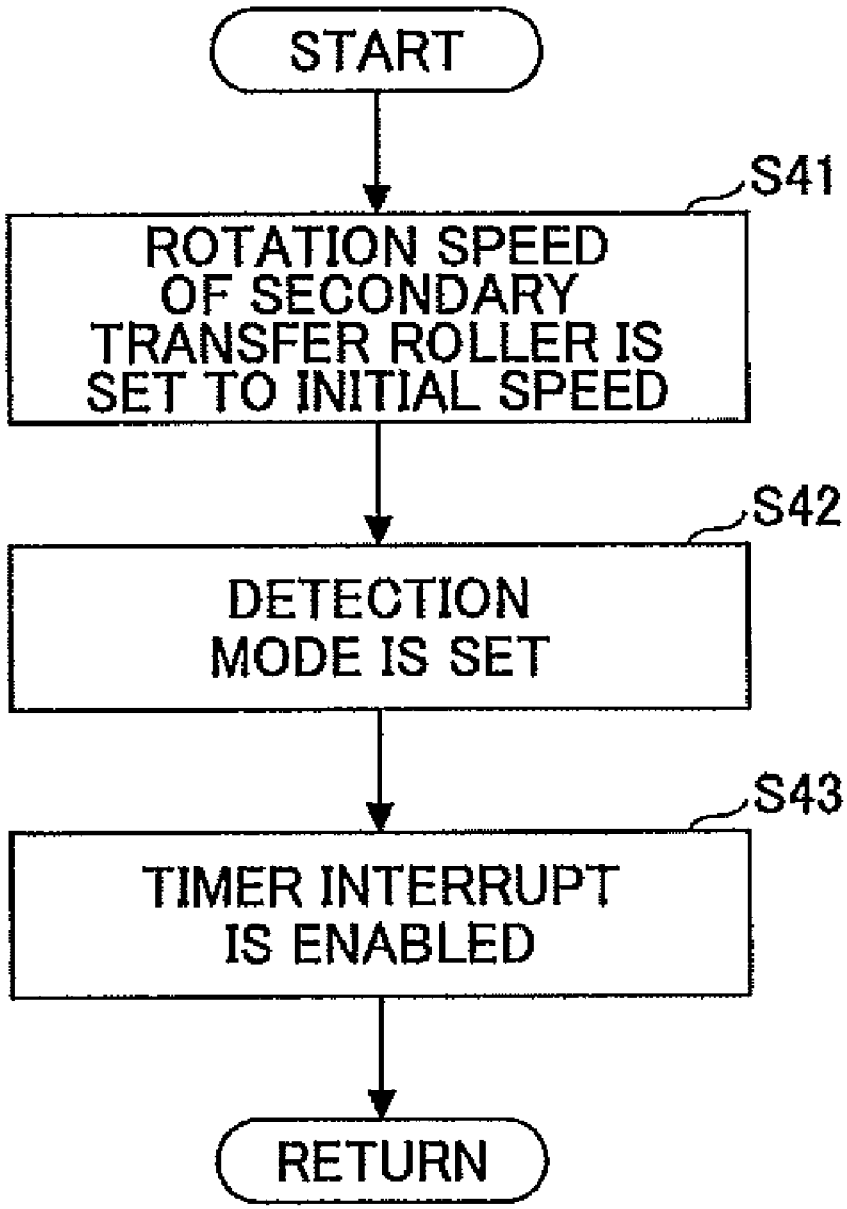
FIG. 7 is a flowchart for explaining an initial operation of the image forming device of the first embodiment.
Figure 8:
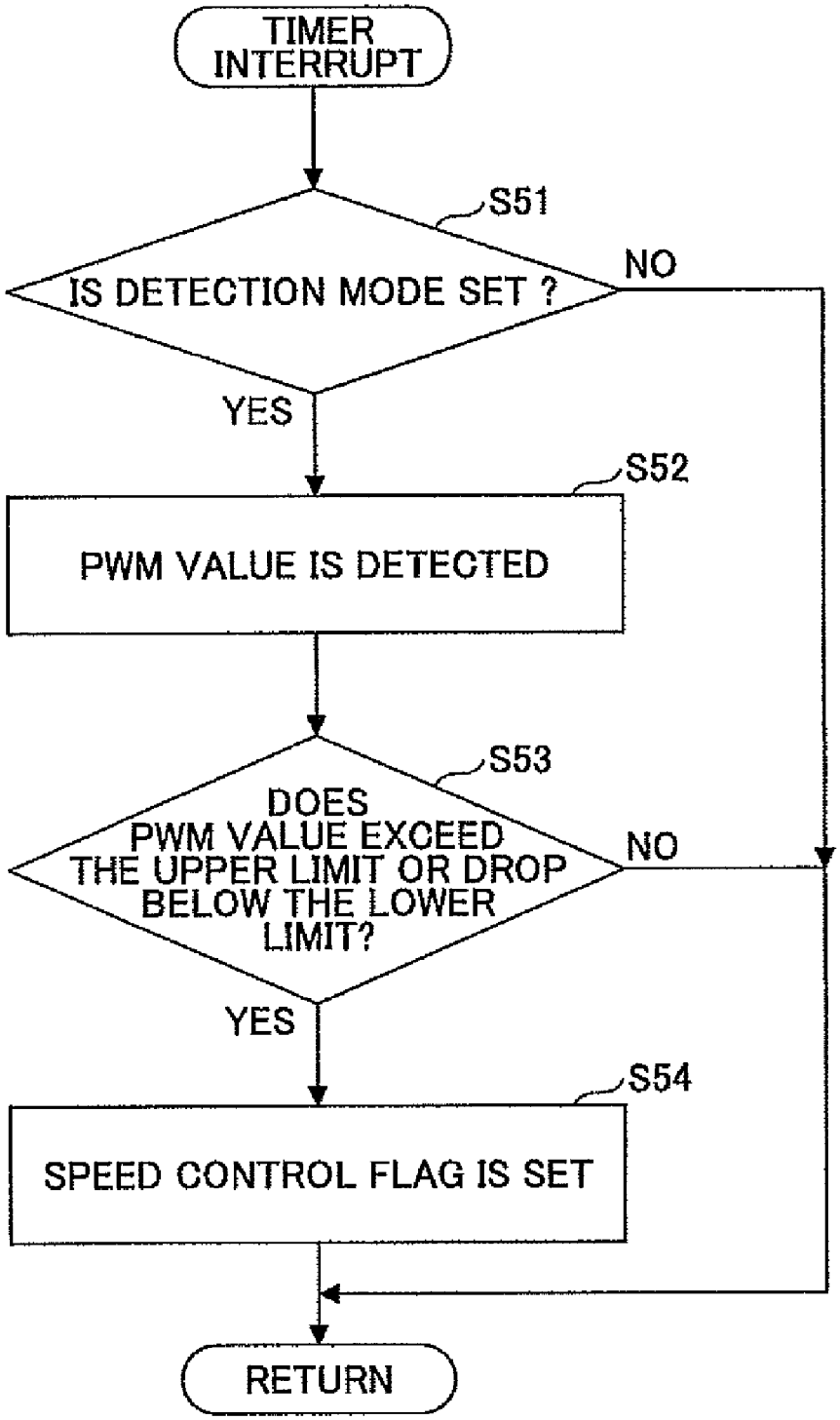
FIG. 8 is a flowchart for explaining detection of a PWM value by an output monitoring unit in the mage forming device of the first embodiment.

FIG. 7 is a flowchart for explaining an initial operation of the image forming device 100A.

Upon starting of the image forming device 100A, the intermediate transfer drive motor 200 and the secondary transfer motor start operation, and the intermediate transfer driving roller and the secondary transfer roller 71 start rotation.

As shown in FIG. 7, in step S41, if the rotation of the intermediate transfer driving roller and the secondary transfer roller 71 is stabilized, a rotational speed of the secondary transfer roller 71 in a stable state is set to an initial speed in the rotational speed control of the secondary transfer roller 71. Progressing to step S42, a detection mode which detects a torque command value of the intermediate transfer drive motor 200 is set up. Progressing to step S43, a timer interrupt is enabled.

Next, the detection of a PWM value by the output monitoring unit 500A will be explained with reference to FIG. 8. FIG. 8 is a flowchart for explaining the detection of a PWM value by the output monitoring unit 500A.

The output monitoring unit 500A detects periodically a PWM value which is output to the PWM unit 350 from the digital filter of the intermediate transfer drive motor driving unit 300.

In step S51, the output monitoring unit 500A determines whether the detection mode is set up.

When the detection mode is set up, the control progresses to step S52. In step S52, the output monitoring unit 500A detects a PWM value by using the torque command value detecting unit 520.

Progressing to step S53, the judgment unit 530 determines whether the detected PWM value exceeds the upper limit or the lower limit set by the upper-limit/lower-limit setting unit 510.

When the PWM value exceeds the upper limit or the lower limit, the control progresses to step S54. In step S54, the flag setting unit 531 sets the speed control flag to the speed control unit 600A.

When the PWM value exceeds the upper limit or the lower limit, the target value command unit 540 in the output monitoring unit 500A outputs the command to increase a rotational speed of the secondary transfer roller 71 or the command to decrease a rotational speed of the secondary transfer roller 71, to the speed control unit 600A.

Next, the speed control of the secondary transfer roller 71 performed by the image forming device 100A of this embodiment will be explained with reference to FIG. 9. FIG. 9 is a flowchart for explaining the rotational speed control of secondary transfer roller 71 performed by the image forming device 100A.

Figure 9:
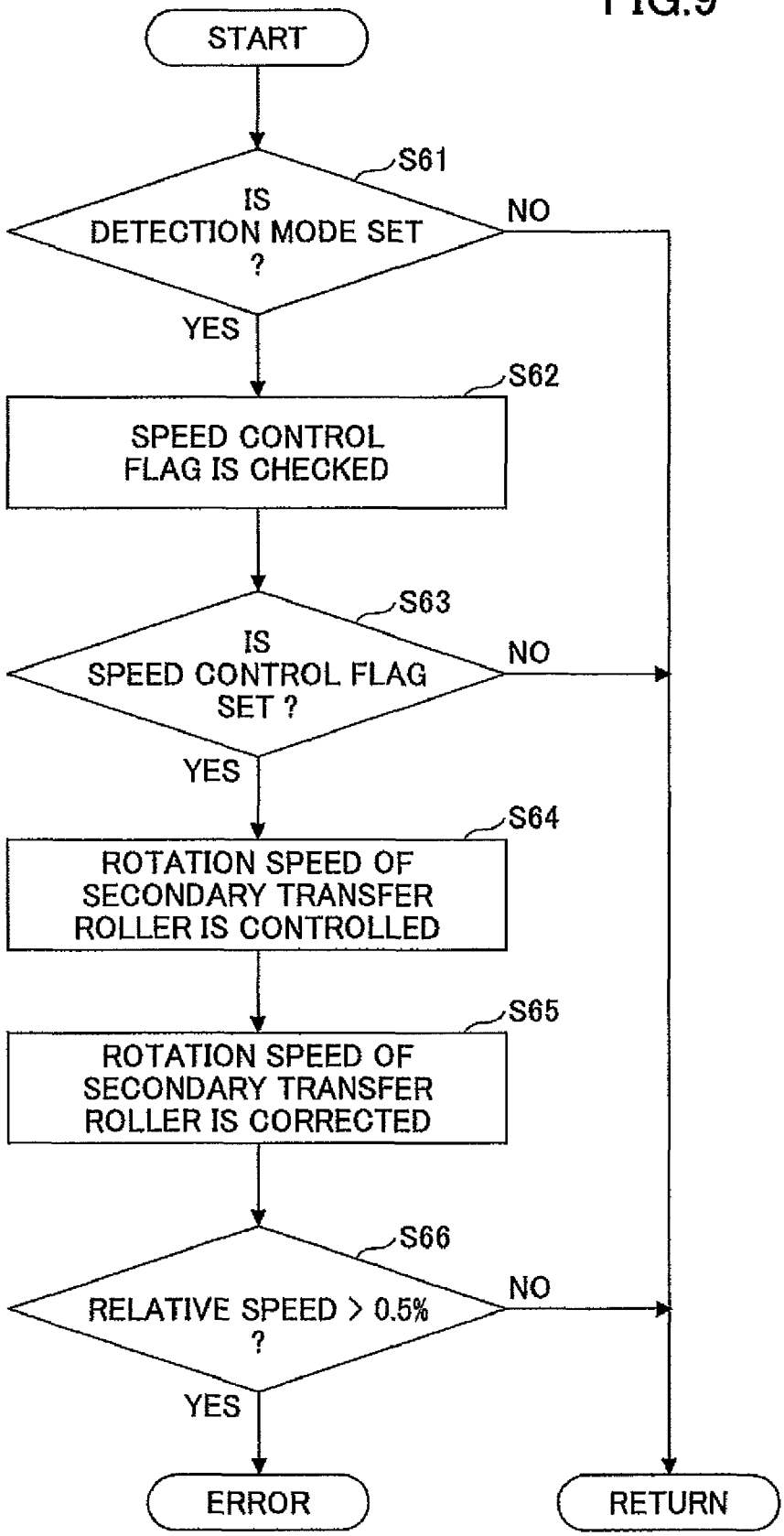
FIG. 9 is a flowchart for explaining a rotational speed control of the secondary transfer roller performed by the image forming device of the first embodiment.

As shown in FIG. 9, in step S61, the speed control unit 600A detects whether the PWM value detection mode is set to the output monitoring unit 500A. When the detection mode is set, the control progresses to step S62.

In step S62, the speed control unit 600A checks whether the speed control flag is set by the flag detecting unit 612.

When the speed control flag is set in step S63, the control progresses to step S64. In step S64, the speed control unit 600A controls a rotational speed of the secondary transfer roller 71.

Next, the speed control performed by the speed control unit 600A in this embodiment will be explained. For the sake of convenience, the case in which it is determined by the judgment unit 530 that the PWM value drops below the lower limit will be described.

If the speed control which decreases a rotational speed of the secondary transfer roller 71 is performed when the PWM value drops below the lower limit, then the PWM value can be changed to fall within the relative-speed tolerance H2. Therefore, in this case, the target value command unit 540 of the output monitoring unit 500A is caused to output the command to decrease a rotational speed of the secondary transfer roller 71, to the speed control unit 600A.

In the speed control unit 600A of this embodiment, the target value selecting unit 620 chooses a target value which is larger by one increment than the target value which was chosen before the command to decrease the rotational speed of the secondary transfer roller 71 is received.

For example, suppose that a first target value which decreases a rotational speed of the secondary transfer roller 71 by 0.05% and a second target value which decreases a rotational speed of the secondary transfer roller 71 by 0.10% are stored in the target value storing unit 610, and that the target value chosen before the command to decrease the rotational speed of the secondary transfer roller 71 is received is the first target value. In such a case, the target value selecting unit 540 chooses the second target value which decreases the rotational speed of the secondary transfer roller 71 by 0.10%.

When the target value is chosen by the target value selecting unit 620, the speed control unit 600A causes the speed command outputting unit 630 to output the chosen target value (speed command value) to the secondary transfer motor drive unit 400.

The secondary transfer motor drive unit 400 generates a speed reference clock based on this target value (speed command value), and changes the rotational speed of the secondary transfer roller 71 which is rotated by the secondary transfer motor.

After the rotational speed of the secondary transfer roller 71 is changed in step S64, the control progresses to step S65. In step S65, the speed correction in accordance with the temperature characteristics of the secondary transfer roller 71 is performed by the speed correcting unit 640. In this manner, the speed control of the secondary transfer roller 71 is completed.

The target value in this embodiment may be replaced by a torque command value. In this case, the target value selecting unit 620 may be arranged to compute a difference between the PWM value detected by the torque command value detecting unit 520 and the torque command value (target value), and choose a torque command value (target value) based on the computed difference. The target value selecting unit 620 in this case may include a table which associates differences and target values, and the target value selecting unit 620 chooses, from among those stored in the target value storing unit 610, a target value associated in the table with the difference computed by the output monitoring unit 500A.

The target value selecting unit 620 may be arranged to select a target value which changes the relative speed to fall within the relative-speed variable range H. Alternatively, the target value selecting unit 620 may be arranged to select a target value which makes the relative speed closest to 0.

For example, when the target value which makes the relative speed closest to 0 is chosen, the target value selecting unit 620 may be arranged to store as an ideal value a target value which is equivalent to the PWM value corresponding to the torque Tc at the operating point C when the relative speed is equal to 0 as shown in FIG. 6.

The target value selecting unit 620 may be arranged to choose a target value which makes the relative speed closest to 0, by using the difference computed by the output monitoring unit 500A and the stored ideal value.

Next, the speed correction performed by the speed correcting unit 640 will be explained.

Generally, the secondary transfer roller 71 expands if the temperature of the secondary transfer roller 71 or the temperature in the housing of the image forming device 100A rises, and the radius of the roller 71 becomes large, which causes the peripheral speed of the secondary transfer roller 71 to be changed.

To eliminate the problem, the speed correcting unit 640 corrects the peripheral speed of the secondary transfer roller 71 based on the relationship between the peripheral speed of the secondary transfer roller 71 and the temperature.

Figure 10:
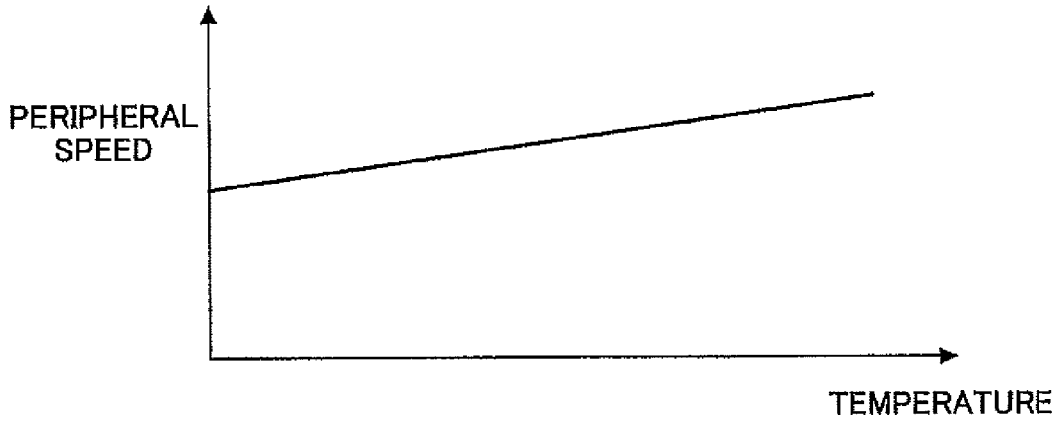
FIG. 10 is a diagram for explaining the relationship between a peripheral speed of the secondary transfer roller and a temperature.

FIG. 10 is a diagram for explaining the relationship between the peripheral speed of secondary transfer roller 71 and the temperature.

The speed correcting unit 640 corrects the peripheral speed V of the secondary transfer roller 71 in accordance with the correction formula: $Vc=V\times(1+\alpha\,\Delta K)$ where $\alpha$ denotes a thermal expansion coefficient, K denotes a temperature, and Vc denotes a peripheral speed after speed correction.

Referring back to FIG. 9, the control progresses to step S66 after the step S65. In step S66, the output monitoring unit 500A detects the PWM value after the speed control of the secondary transfer roller 71 is completed.

The output monitoring unit 500A causes the judgment unit 530 to determine whether the PWM value after the speed control exceeds an upper limit or drops below a lower limit. Namely, the output monitoring unit 500A detects whether the relative speed is within the relative-speed tolerance H2.

The relative-speed tolerance H2 in this embodiment is assumed to be 0.4% of the peripheral speed of the secondary transfer roller 71 and the surface speed of the intermediate transfer belt 51.

When the relative speed is not within the relative-speed tolerance H2 in step S66, the processing of the steps S61 to S65 is repeated.

When the relative speed exceeds the relative-speed range H1, the output monitoring unit 500A outputs the command to stop operation of the image forming device 100A as an operation error. The relative-speed range H1 in this embodiment is assumed to be 0.5% of the peripheral speed of the secondary transfer roller 71 and the surface speed of the intermediate transfer belt 51.

As explained above, in this embodiment, the rotational speed of the secondary transfer roller 71 is controlled based on the torque command value to the intermediate transfer drive motor which drives the intermediate transfer belt 51, so that the relative speed of the secondary transfer roller 71 to the surface speed of the intermediate transfer belt 51 falls within the tolerance. Therefore, according to this embodiment, an appropriate speed control can is be carried out to eliminate speed fluctuations of the peripheral speed of the secondary transfer roller 71 and the surface speed of the intermediate transfer belt 51 without increasing the number of component parts and the cost. According to this embodiment, the speed control is performed to make the relative speed fall within the tolerance. Thus, it is possible to prevent the intermediate transfer drive motor from being held in an uncontrollable state, and it is possible to prevent the forced movement of the intermediate transfer belt 51 by the secondary transfer roller 71.

In this embodiment, the intermediate transfer drive motor driving unit 300, the output monitoring unit 500A, and the speed control unit 600A may be integrated into a semiconductor device 700A. In this case, the image forming device 100A can perform the functions of the above units 300, 500A, 600A by mounting the semiconductor device 700A in the image forming device 100A.

In this embodiment, it is assumed that the surface speed of the intermediate transfer belt 51 is a fixed speed. Alternatively, fine adjustment of the surface speed of the intermediate transfer belt 51 may be performed when the rotational speed of the secondary transfer roller 71 is changed. In this case, the intermediate transfer drive motor driving unit 300 may be arranged to change the torque command value to the intermediate transfer drive motor 200 based on the speed command value output to the secondary transfer motor drive unit 400, and control the intermediate transfer drive motor 200.

The image forming device 100A of this embodiment may be arranged to include an alarm unit (not shown) which outputs an alarm when the relative speed after the speed control does not fall within the relative-speed tolerance H2. The image forming device 100A of this embodiment may be arranged to include a temperature sensor (not shown) which detects the temperature of the secondary transfer roller 71.

In this embodiment, the secondary transfer roller is considered as a second rotary member. Alternatively, the speed control in this embodiment is also applicable to a case in which the secondary transfer belt is considered as a second rotary member. When the secondary transfer belt is considered as a second rotary member, the speed control unit may be arranged to adjust the rotational speed of the roller which rotates the secondary transfer belt, so that the surface speed of the intermediate transfer belt and the secondary transfer belt may fall within a predetermined range.

Next, the second embodiment of the invention will be explained.

In the second embodiment of the invention, the composition of the output monitoring unit 500 differs from that in the first embodiment. Other components of the second embodiment are the same as those of the first embodiment. A description will be given of only the difference in the output monitoring unit 500 between the second embodiment and the first embodiment. In the second embodiment, the elements which are the same as corresponding elements in the first embodiment are designated by the same reference numerals, and a description thereof will be omitted.

The image forming device 100B of this embodiment is arranged to detect that the intermediate transfer drive motor 200 is held in an uncontrollable state, and control the rotational speed of the secondary transfer roller 71 on such an occasion. In the image forming device 100B, when the PWM value (torque command value) decreases from the first lower limit to the second lower limit in a predetermined time, it is determined that the intermediate transfer drive motor 200 is held in an uncontrollable state. The details of the uncontrollable state of the intermediate transfer drive motor 200 will be described later.

Figure 11:
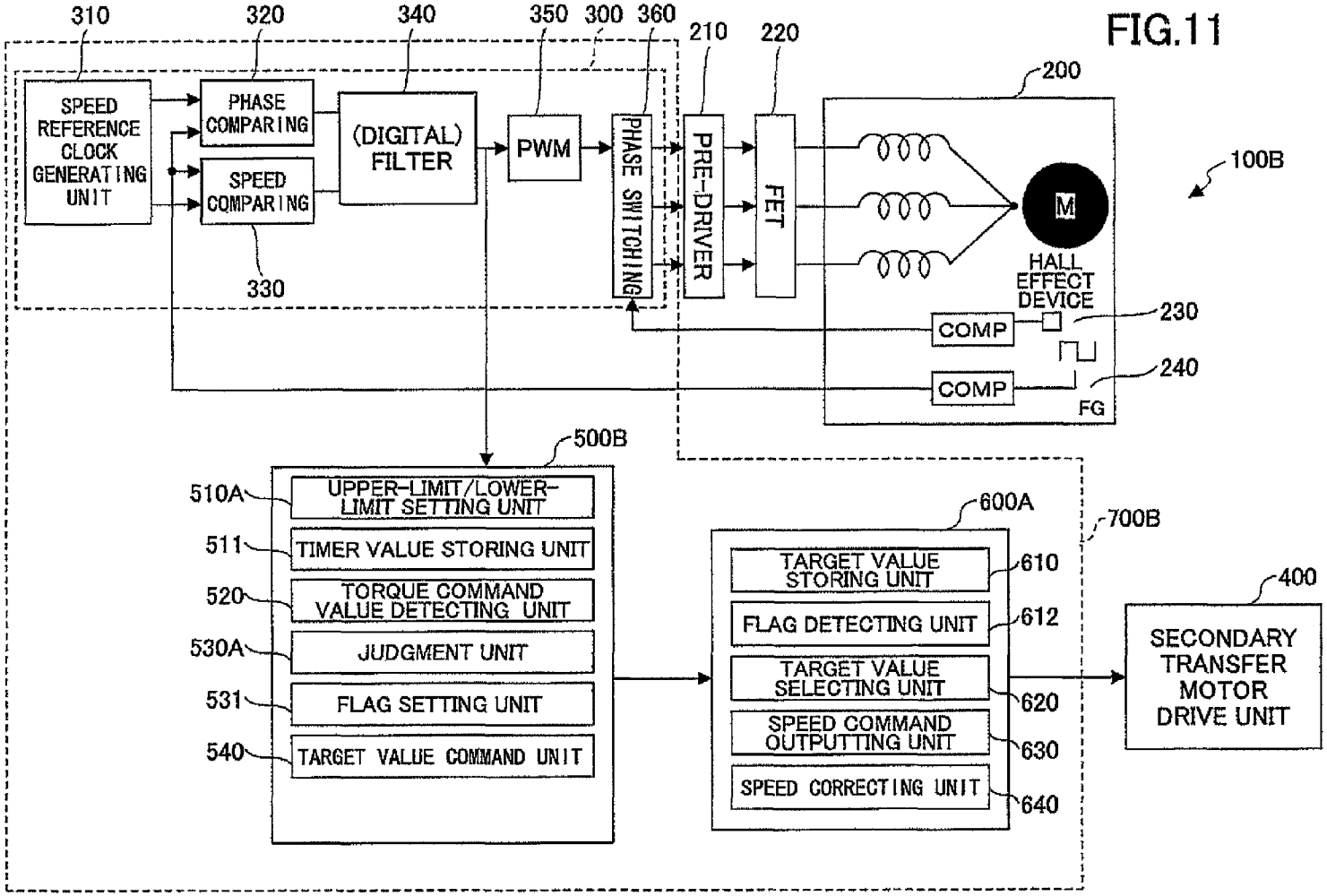
FIG. 11 is a diagram showing the composition of an image forming device of a second embodiment of the invention.

FIG. 11 shows the composition of the image forming device 100B of the second embodiment.

The output monitoring unit 500C in the image forming device 100B of this embodiment includes an upper-limit/lower-limit setting unit 510A, a timer value storing unit 511, a torque command value detecting unit 520, a judgment unit 530A, a flag setting unit 531, and a target value command unit 540.

The upper-limit/lower-limit setting unit 510A sets up a first lower limit P and a second lower limit Q, in addition to the upper limit and the lower limit of a torque command value based on the torque in the region Z as shown in FIG. 6. The first lower limit P and the second lower limit Q, set by the upper-limit/lower-limit setting unit 510A, are determined beforehand based on experimental data. For example, the first lower limit P and the second lower limit Q are set up beforehand in the upper-limit/lower-limit setting unit 510A at the time of shipment of the image forming device 100B.

The timer value storing unit 511 stores a timer value counted by the timer (not illustrated) provided in the image forming device 100B.

The first lower limit P and the second lower limit Q set by the upper-limit/lower-limit setting unit 510A will be explained with reference to FIGS. 12 to 15.

The first lower limit P and the second lower limit Q set by the upper-limit/lower-limit setting unit 510A in this embodiment are provided in order to determine whether the intermediate transfer drive motor 200 is held in an uncontrollable state.

Figure 12:
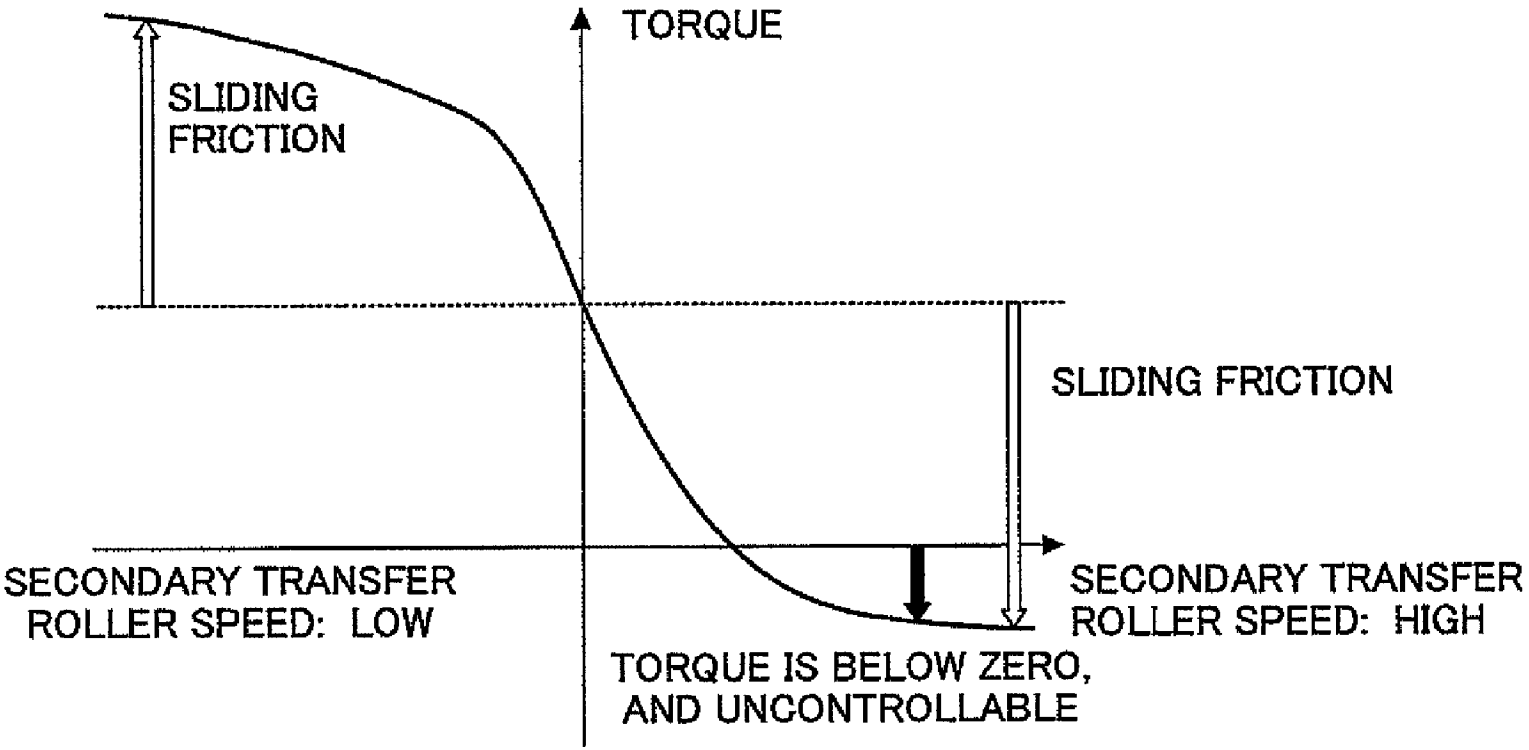
FIG. 12 is a diagram for explaining the relationship between a peripheral speed and a torque of the secondary transfer roller in the image forming device of the second embodiment.

Next, the uncontrollable state of the intermediate transfer drive motor 200 will be explained. FIG. 12 is a diagram for explaining the relationship between a peripheral speed and a torque of the secondary transfer roller 71 in the image forming device 100B.

As shown in FIG. 12, when the peripheral speed of the secondary transfer roller 71 is smaller than the peripheral speed of the intermediate transfer driving roller, the torque of the intermediate transfer driving roller becomes large due to sliding friction to the intermediate transfer belt 51 at the nip portion of the secondary transfer roller 71 and the intermediate transfer belt 51.

On the other hand, when the peripheral speed of the secondary transfer roller 71 is larger than the peripheral speed of the intermediate transfer driving roller, the torque of the intermediate transfer driving roller becomes small. If the peripheral speed of the secondary transfer roller 71 increases beyond a certain speed, the value of the torque is below zero (a negative value) and the intermediate transfer belt 51 is forcibly moved by the secondary transfer roller 71, so that the intermediate transfer driving roller is held in an uncontrollable state.

Figure 13A:
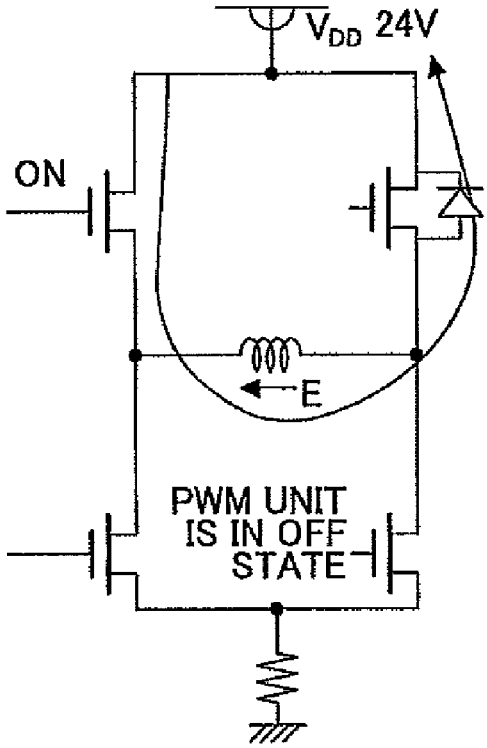
FIG. 13A and FIG. 13B are diagrams for explaining PWM driving of an intermediate transfer drive motor in an uncontrollable state.
Figure 13B:
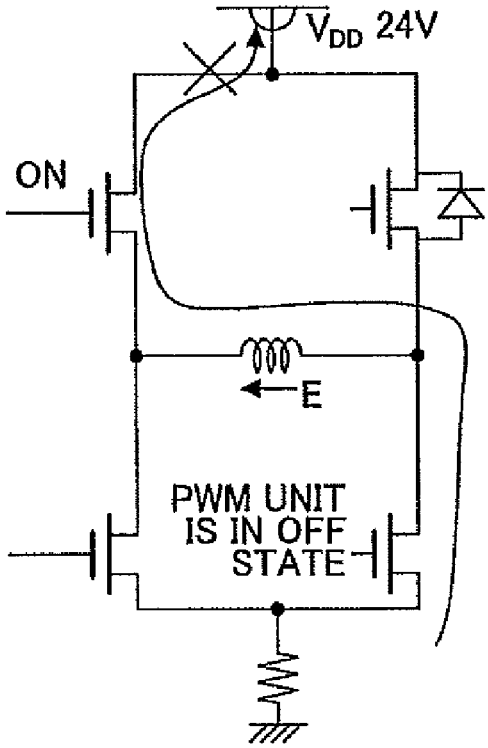

FIGS. 13A and 13B are diagrams for explaining PWM driving of the intermediate transfer drive motor 200 in an uncontrollable state.

When the intermediate transfer belt 51 is forcibly moved by the secondary transfer roller 71 in the image forming device 100B and the intermediate transfer drive motor 200 is in an uncontrollable state, the torque to the intermediate transfer drive motor 200 is a negative value, and a reverse-direction electromotive force E works on the coil.

As shown in FIG. 13A, when the current flows through the coil rightward in a period when the PWM unit is in OFF state, a regenerative current flows. As shown in FIG. 13B, when the current flows through the coil leftward, any regenerative current does not flow. The intermediate transfer drive motor 200 is held in an uncontrollable state due to this asymmetrical phenomenon.

Figure 14:
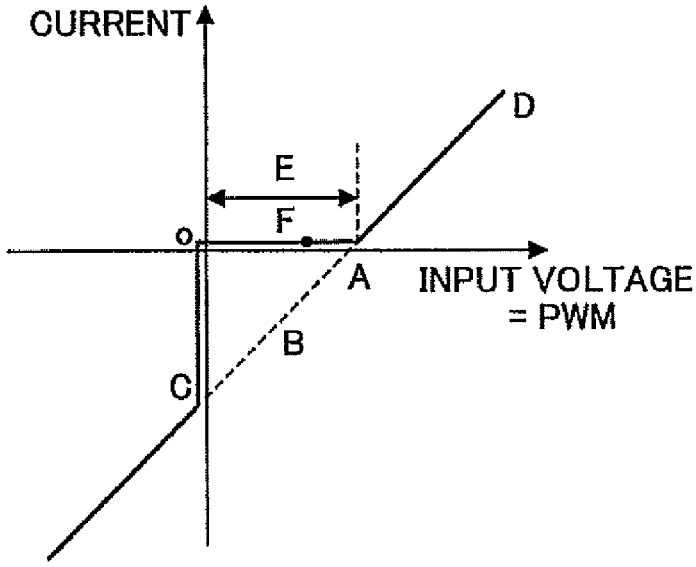
FIG. 14 is a diagram for explaining an operating point in an uncontrollable state.

FIG. 14 is a diagram for explaining the operating point in an uncontrollable state. In FIG. 14, the vertical axis represents an average current and the horizontal axis represents a PWM value. FIG. 14 shows the relationship between the current value and the PWM value of the intermediate transfer drive motor 200.

As shown in FIG. 14, when the operating point is located between point A and point C in the relationship between the current value and the PWM value of the intermediate transfer drive motor 200, the control of the current value to follow the dotted line B cannot be performed due to the asymmetrical phenomenon as shown in FIGS. 13A and 13B. The operating point will trace the line segment A-O and the line segment O-C.

That is, when the operating point is located between point A and point D, the current is controlled according to the PWM value. However, when the operating point comes to point F on the left side of point A, the current is unchanged even if the PWM value is decreased. At this time, the intermediate transfer drive motor 200 is held in an uncontrollable state.

When the intermediate transfer drive motor 200 is held in an uncontrollable state, the torque is unchanged even if the PWM value is decreased. Therefore, the intermediate transfer drive motor driving unit 300 continuously performs the control to decrease the PWM value further.

In a normal PWM value control, the PWM value to the intermediate transfer drive motor 200 does not decrease rapidly. The PWM value decreases rapidly only when an uncontrollable state occurs. Therefore, the image forming device of this embodiment is arranged to determine that the intermediate transfer drive motor 200 is held in an uncontrollable state, when a detected PWM value decreases rapidly, and to immediately start performing the control of a rotational speed of the secondary transfer roller 71.

Figure 15:
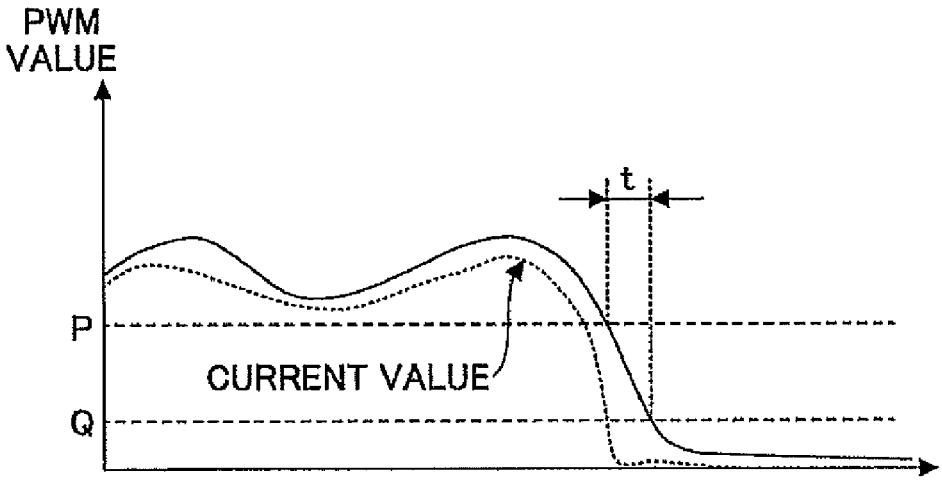
FIG. 15 is a diagram for explaining a case in which the control to decrease a PWM value is continuously performed by an intermediate transfer drive motor driving unit.

FIG. 15 is a diagram for explaining a case in which the control to decrease a PWM value is continuously performed by the intermediate transfer drive motor driving unit 300. In this embodiment, in order to determine an uncontrollable state, a first lower limit P and a second lower limit Q are set up. The second lower limit Q is set to a value at which a corresponding current value remains unchanged even it a corresponding PWM value is decreased. The first lower limit P is set up as the value which is produced by adding a predetermined tolerance to the second lower limit Q.

In this embodiment, when a PWM value decreases from the first lower limit P to the second lower limit Q within a predetermined time t in a PWM value, it is determined that the PWM value decreases rapidly and an uncontrollable state occurs. Suppose that the first lower limit P, the second lower limit Q, and the predetermined time t are determined based on experimental values obtained through the experiment.

Figure 16:
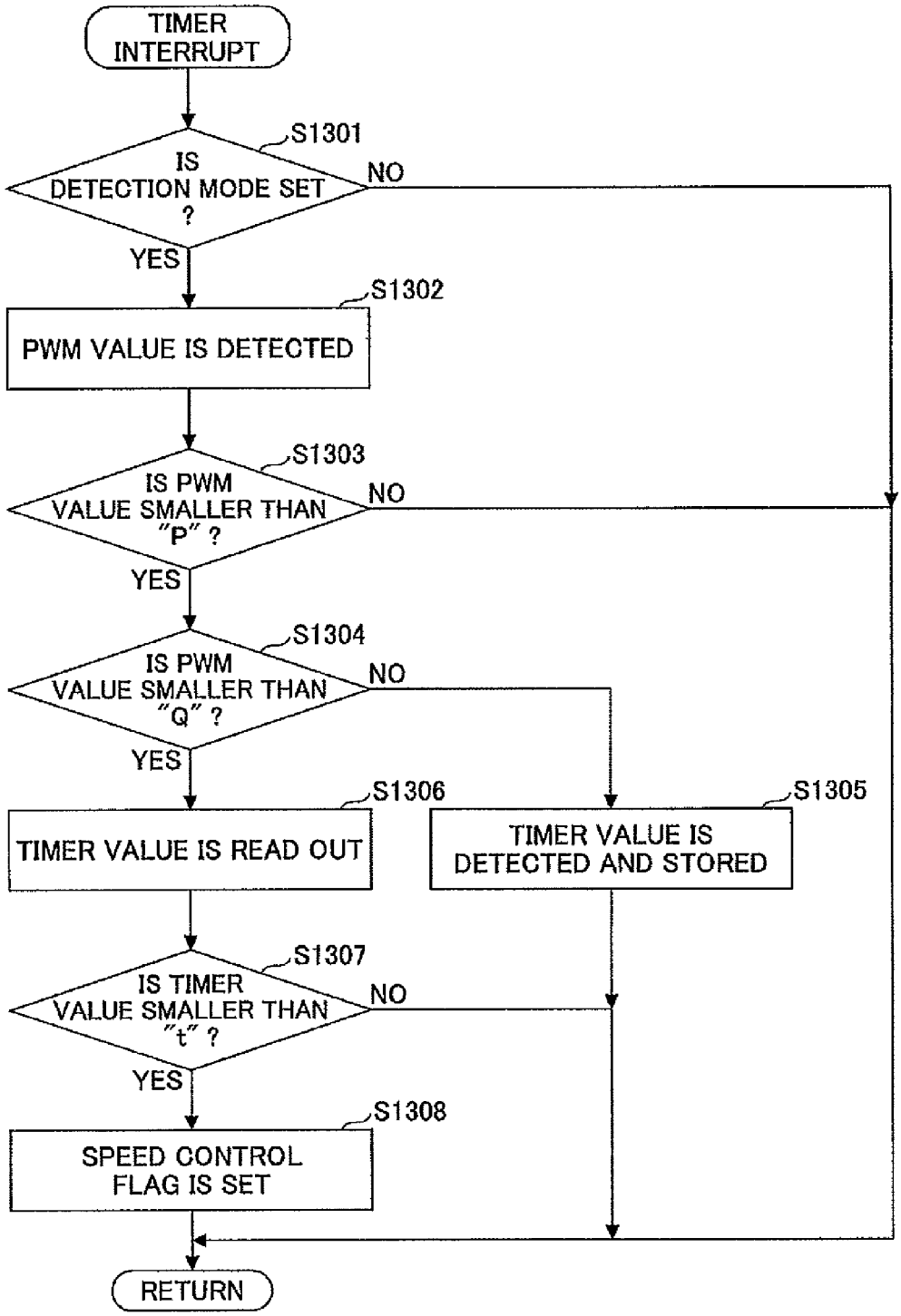
FIG. 16 is a flowchart for explaining the detection of a PWM value performed by an output monitoring unit.

Next, the detection of a PWM value performed by the output monitoring unit 500B in the image forming device 100B of this embodiment will be explained with reference to FIG. 16. FIG. 16 is a flowchart for explaining the detection of a PWM value performed by the output monitoring unit 500B.

The output monitoring unit 5003 of this embodiment detects periodically a PWM value output from the digital filter to the PWM unit 350 of the intermediate transfer drive motor driving unit 300. The initial operation of the image forming device 100B is the same as that in the first embodiment, and a description thereof will be omitted.

In step S1301, the output monitoring unit 500B determines whether the detection mode is set up. When the detection mode is set up, the control progresses to step S1302. In step S1302, the output monitoring unit 500B detects a PWM value by using the torque command value detecting unit 520.

Progressing to step S1303, the judgment unit 530A determines whether the detected PWM value is smaller than the first lower limit P.

When the PWM value is smaller than the first minimum P, the control progresses to step S1304. In step S1304, the judgment unit 530A determines whether the detected PWM value is smaller than the second lower limit Q.

When the PWM value is larger than the second lower limit Q in step S1304, the control progresses to step S1305. In step S1305, the timer value storing unit 511 detects a timer value indicating a period from the time it was determined that the PWM value is smaller than the first lower limit P to the time the PWM value is compared with the second lower limit Q (the processing of step S1304), and stores the timer value.

When the PWM value is smaller than the second lower limit Q in step S1304, the control progresses to step S1306. In step S1306, the judgment unit 530A reads out the timer value currently stored in the timer value storing unit 511.

Progressing to step S1307, the judgment unit 530A determines whether the read timer value is smaller than a predetermined time t. When it is determined in the step S1307 that the timer value is smaller than the predetermined time t, the judgment unit 530A determines that the image forming device 100B is in an uncontrollable state. When the uncontrollable state is detected by the judgment unit 530A, the control progresses to step S1308. In step S1308, the flag setting unit 531 sets the speed control flag in the speed control unit 600A.

At this time, the target value command unit 540 outputs the command to decrease the rotational speed of the secondary transfer roller 71, to the speed control unit 600A.

The speed control performed by the speed control unit 600A in this embodiment is the same as that in the first embodiment described above, and a description thereof will be omitted.

As described above, the image forming device 100B of this embodiment determines an uncontrollable state of the intermediate transfer drive motor 200 based on a detected PWM value (which is a torque command value to the intermediate transfer drive motor 200), and performs the control of a rotational speed of the secondary transfer roller 71.

Therefore, according to this embodiment, an appropriate speed control can be carried out to eliminate speed fluctuations of the peripheral speed of the secondary transfer roller 71 and the surface speed of the intermediate transfer belt 51 without increasing the number of component parts and the cost. According to this embodiment, it is possible to prevent the control operation from being continuously performed with the intermediate transfer drive motor in an uncontrollable state, and an appropriate speed control can be performed promptly.

In this embodiment, the intermediate transfer drive motor driving unit 300, the output monitoring unit 500B, and the speed control unit 600A may be integrated into a semiconductor device 700B. In this case, the image forming device 100B can perform the functions of the above-mentioned units 300, 500B, and 600A by mounting the semiconductor device 700B in the image forming device 100B.

Next, the image forming device of a third embodiment of the invention will be explained.

The image forming device of the third embodiment is a modification of the second embodiment described above. The third embodiment differs from the second embodiment in that an output detecting unit 500C detects a PWM value equivalent to the first lower limit P as in the second embodiment. Only the differences of the third embodiment from the second embodiment will be explained. The elements in the third embodiment which are the same as corresponding elements in the second embodiment are designated by the same reference numerals, and a description thereof will be omitted.

Figure 17:
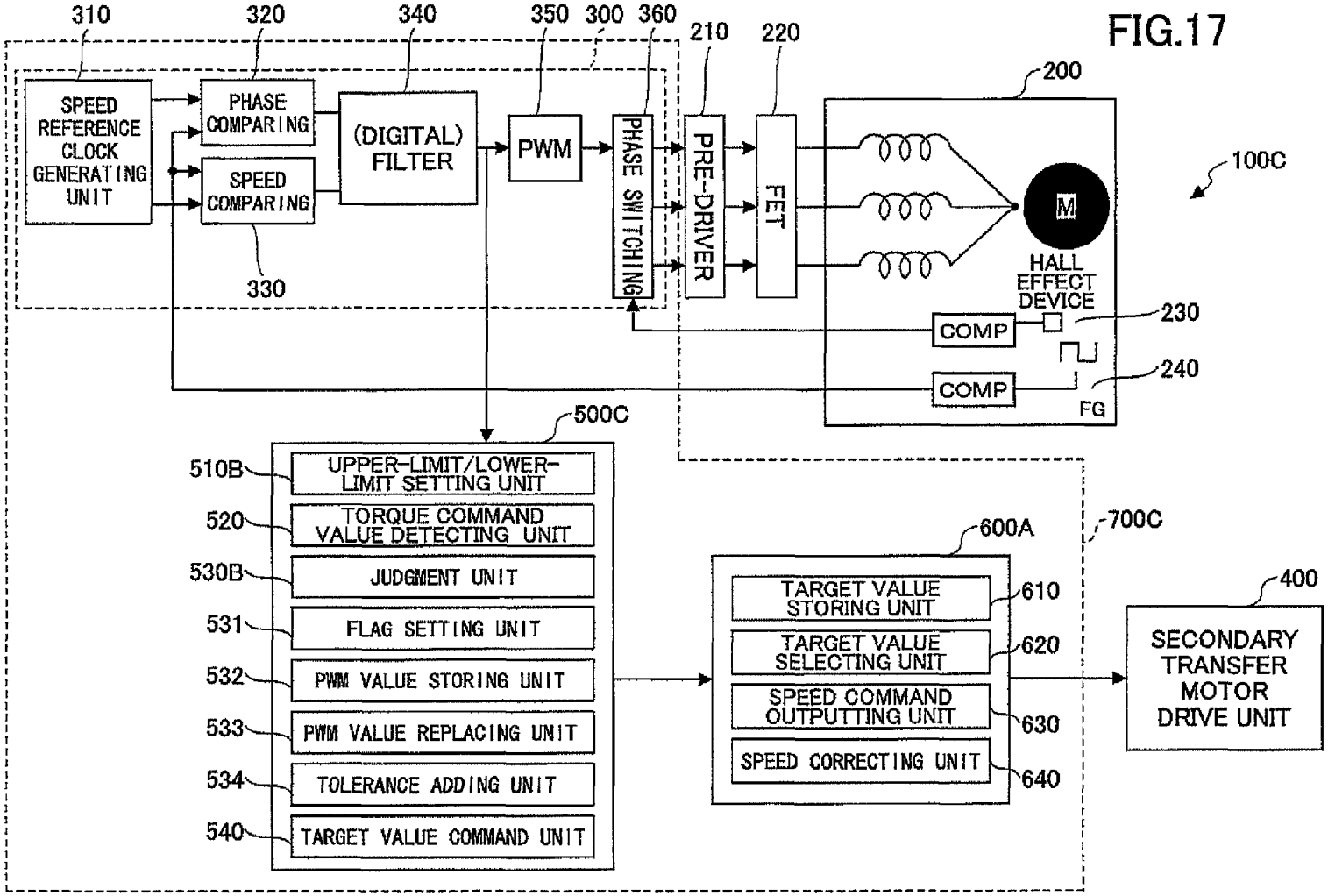
FIG. 17 is a block diagram showing the composition of an image forming device of a third embodiment of the invention.

FIG. 17 shows the composition of an image forming device 100C of the third embodiment of the invention.

The output monitoring unit 50C in the image forming device 100C of this embodiment includes an upper-limit/lower-limit setting unit 510B, a torque command value detecting unit 520, a judgment unit 530B, a flag setting unit 531, a PWM value storing unit 532, a PWM value replacing unit 533, a tolerance adding unit 534 and a target value command unit 540.

A lower limit Ps detected by the output monitoring unit 500C and a lower limit Q1 equivalent to the second lower limit Q previously described in the second embodiment are set to the upper-limit/lower-limit setting unit 510B. [Is this correct? You refer to two lower limits and then you say that they are set to a upper/lower limit.] The lower limit Q1 is a value which is set up beforehand based on experimental data. The details of the lower limit Ps will be mentioned later.

The judgment unit 530B determines whether the PWM value detected by the torque command value detecting unit 520 is smaller than the minimum of the PWM values stored in the PWM value storing unit 532 (which will be mentioned later). Moreover, the judgment unit 530B determines whether the PWM value detected by the torque command value detecting unit 520 is smaller than the PWM value Ps1 (which will be mentioned later).

The PWM value storing unit 532 stores the PWM values which have been detected by the torque command value detecting unit 520.

The PWM value replacing unit 533 replaces a PWM value by another PWM value. The tolerance adding unit 534 adds a predetermined tolerance to the PWM value produced by the PWM value replacing unit 533. The tolerance used by the tolerance adding unit 534 is determined beforehand based on experimental data.

Figure 18:
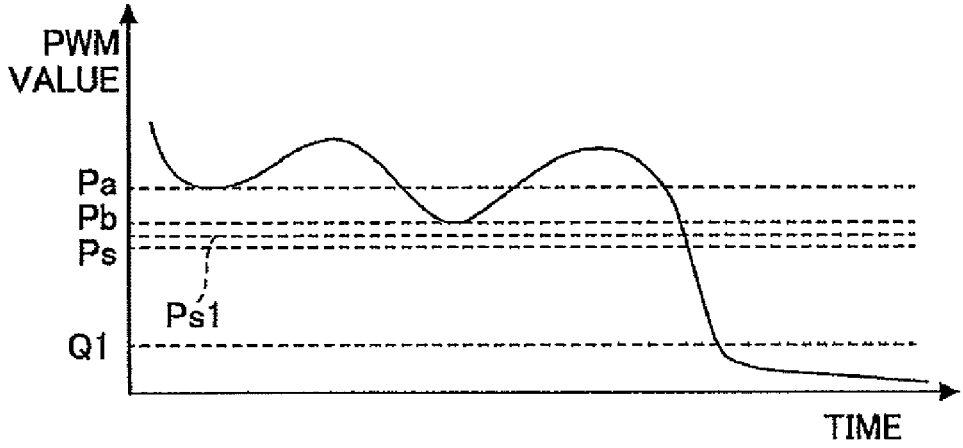
FIG. 18 is a diagram for explaining the relationship between a PWM value and a time in the image forming device of the third embodiment.

Next, the lower limit Q1 and the lower limit Ps in this embodiment will be explained. FIG. 18 is a diagram for explaining the relationship between a PWM value and a time in the image forming device 100C of the third embodiment.

As shown in FIG. 18, in the image forming device 100C, even if the PWM value to the intermediate transfer drive motor 200 decreases to Pa or Pb, the PWM value rises again after a predetermined time passes. However, once the PWM value decreases further to a low level which is smaller than the Pb by a given amount, the PWM value will not rise and it will decrease to the lower limit Q1.

The state in which the PWM value does not rise from the lower limit Q1 means that the intermediate transfer drive motor 200 is held in an uncontrollable state. Namely, if the PWM value decreases to the PWM value Ps which is smaller than the PWM value Pb by a given amount, it will subsequently fall to the lower limit value Q1, and the intermediate transfer drive motor 200 at this time is in an uncontrollable state.

The image forming device of this embodiment is arranged to detect a PWM value Ps which is smaller than the PWM value Pb by a given amount, and set a PWM value Ps1 which is produced by adding a predetermined tolerance to the PWM value Ps, to the upper-limit/lower-limit setting unit 510B. In this embodiment, when the PWM value detected by the torque command value detecting unit 520 is smaller than the PWM value Ps1, the control of the rotational speed of the secondary transfer roller 71 is started.

Figure 19:
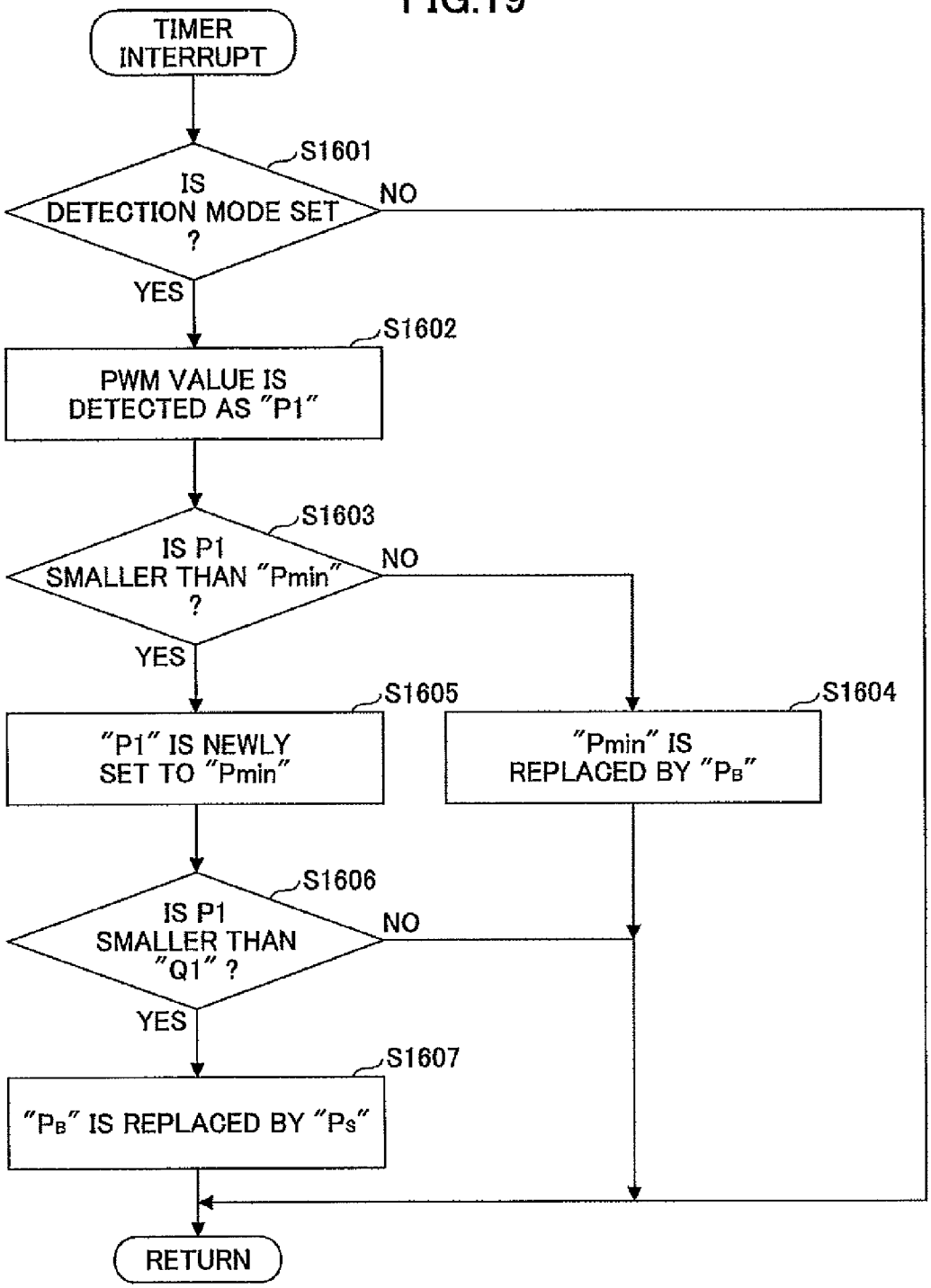
FIG. 19 is a flowchart for explaining the computation of a PWM value performed by the image forming device of the third embodiment.

Next, the detection of a PWM value Ps will be explained. FIG. 19 is a flowchart for explaining the computation of a PWM value Ps performed by the image forming device 100C of the third embodiment.

As shown in FIG. 19, in step S1601, the output monitoring unit 500C determines whether the detection mode is set up.

When the detection mode is set up, the torque command value detecting unit 520 detects a PWM value. Suppose that the PWM value detected by the torque command value detecting unit 520 is a PWM value P1.

Progressing to step S1603, the judgment unit 530B determines whether the PWM value P1 is smaller than the minimum PWM value Pmin among the PWM values which are previously detected and stored in the PWM value storing unit 532.

When the PWM value P1 is larger than the minimum PWM value Pmin in step S1603, the control progresses to step S1604. In step S1604, it is determined that the detected PWM value passes through the minimum point (which corresponds to the Pb in FIG. 18), and the PWM value replacing unit 533 replaces the minimum PWM value Pmin by a PWM value PB at the minimum point.

When the PWM value P1 is smaller than the minimum PWM value Pmin in step S1603, the control progresses to step S1605. In step S1605, the PWM value replacing unit 533 replaces the PWM value P1 by the minimum PWM value Pmin which is considered the minimum value among the PWM values previously detected and stored.

Progressing to step S1606, the judgment unit 530B determines whether the PWM value P1 is smaller than the lower limit Q1 set by the upper-limit/lower-limit setting unit 510B.

When the PWM value P1 is smaller than the lower limit Q1 in step S1606, the control progresses to step S1607. In step S1607, the PWM value replacing unit 533 replaces the minimum point PWM value PB by the PWM value Ps.

Namely, the PWM value replacing unit 533 changes the PWM value equivalent to the PWM value Pb in FIG. 18 to the PWM value Ps. This PWM value Ps indicates a PWM value at which the intermediate transfer drive motor 200 is held in an uncontrollable state.

Although the PWM value (equivalent to the Ps in FIG. 18) at which the intermediate transfer drive motor 200 is actually in an uncontrollable state is smaller than the PWM value Pb, the PWM value Ps detected in the processing of FIG. 19 is changed to a PWM value that is approximately equal to the PWM value Ps indicated in FIG. 18 by repeating the processing of FIG. 19.

After the PWM value Ps is detected as mentioned above, the PWM value Ps1 is computed by adding the predetermined tolerance to the PWM value Ps using the tolerance adding unit 534. The output monitoring unit 500C sets the PWM value Ps1 to the upper-limit/lower-limit setting unit 510B.

In this embodiment, when it is determined by the judgment unit 530B that the PWM value P1 detected by the torque command value detecting unit 520 is smaller than the PWM value Ps1, the speed control flag in the speed control unit 600A is set by the flag setting unit 531. When it is determined that the PWM value P1 is smaller than the PWM value Ps1, the target value command unit 540 outputs the command to decrease the rotational speed of the secondary transfer roller 71 to the speed control unit 600A.

The speed control of the secondary transfer roller 71 performed by the speed control unit 600A in this embodiment is the same as that in the first embodiment described above.

According to this embodiment, the intermediate transfer drive motor 200 detects the PWM value which causes an uncontrollable state to occur, and the value which is produced by adding the predetermined tolerance to the detected PWM value is set up as the lower limit of the torque command value.

Therefore, according to this embodiment, an appropriate speed control can be performed to eliminate speed fluctuations of the peripheral speed of the secondary transfer roller 71 and the surface speed of the intermediate transfer belt 51 without increasing the number of component parts and the cost. According to this embodiment, it is possible to prevent the intermediate transfer drive motor from being held in an uncontrollable state, and it is possible to prevent the forced movement of the intermediate transfer belt 51 by the secondary transfer roller 71.

In this embodiment, the intermediate transfer drive motor driving unit 300, the output monitoring unit 500C, and the speed control unit 600A may be integrated into a semiconductor device 700C as shown in FIG. 17. In this case, the image forming device 100C can perform the functions of the above-mentioned units 300, 500C, and 600A by mounting the semiconductor device 700C in the image forming device 100C.

Next, the image forming device of a fourth embodiment of the invention will be explained. The fourth embodiment is a modification of the first embodiment described above.

The fourth embodiment differs from the first embodiment in that a current value of the intermediate transfer drive motor 200 is computed, and the computed current value is detected as a torque command value. Other components of the fourth embodiment are the same as that of the first embodiment. A description will be given of only the difference between the fourth embodiment and the first embodiment. In the fourth embodiment, the elements which are the same as corresponding elements the first embodiment are designated by the same reference numerals, and a description thereof will be omitted.

Figure 20:
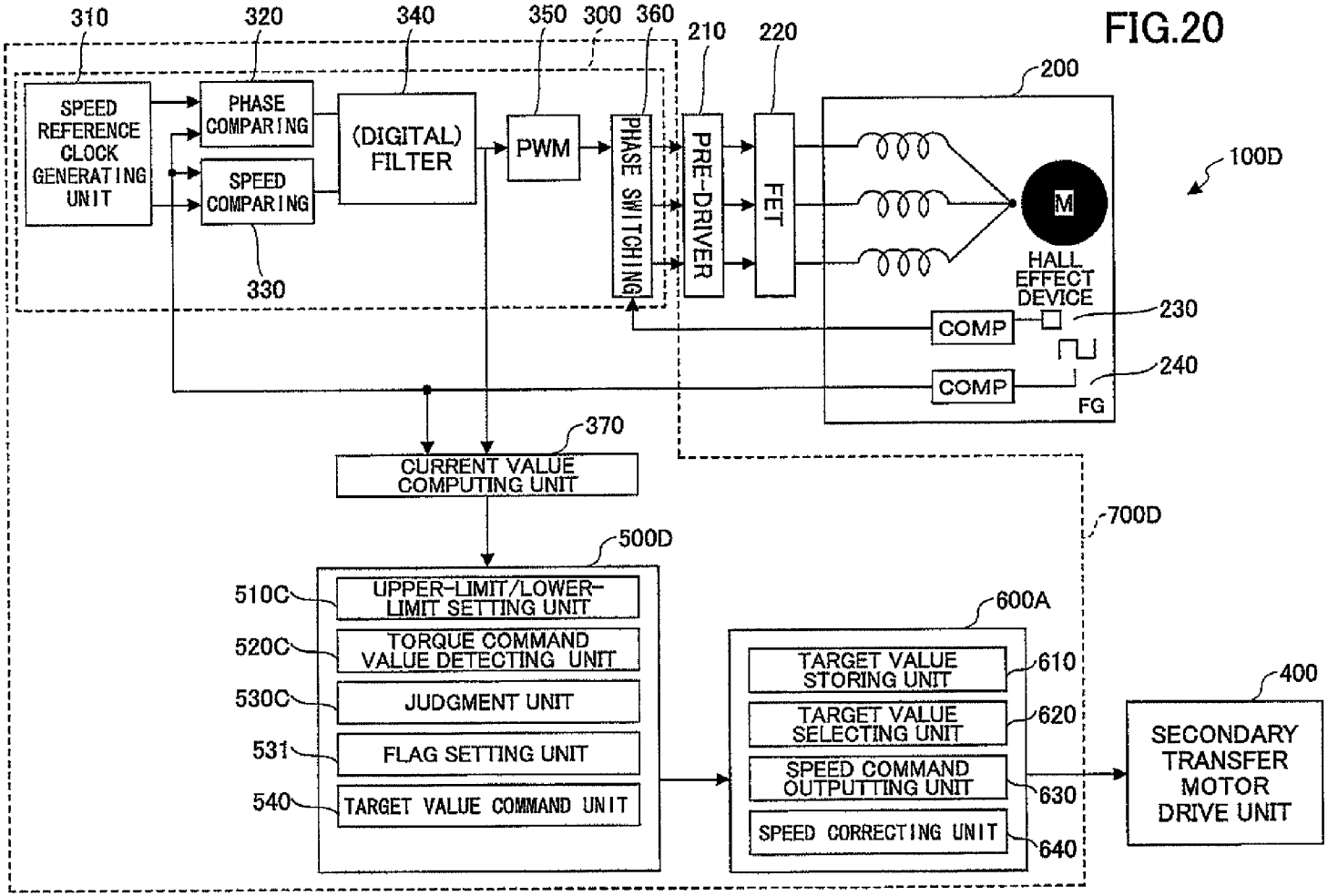
FIG. 20 is a block diagram showing the composition of an image forming device of a fourth embodiment of the invention.

FIG. 20 shows the composition of the image forming device 100D of the fourth embodiment. The image forming device 100D of this embodiment includes a current value computing unit 370.

The current value computing unit 370 acquires the PWM value output to PWM unit 350, and the rotational speed of intermediate transfer drive motor 200 detected by the FG 240 from the digital filter 340, and computes the current value of the intermediate transfer drive motor 200.

Figure 21:
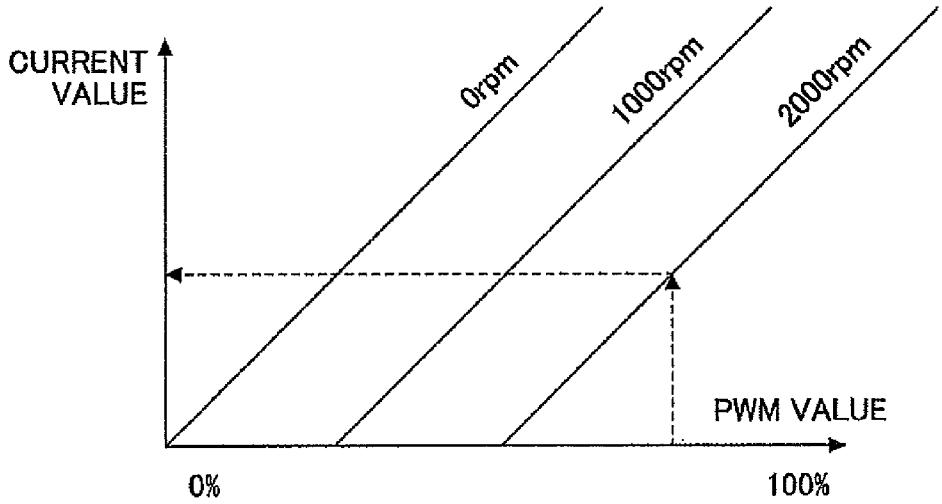
FIG. 21 is a diagram for explaining the relationship between a PWM value and a current value in the image forming device of the fourth embodiment.

According to the rotational speed of the intermediate transfer drive motor 200, the relationship between the PWM value and current value in the image forming device 100D changes, as shown in FIG. 21.

FIG. 21 is a diagram for explaining the relationship between a PWM value and a current value in the image forming device 100D.

The relationship between a PWM value and a current value in the image forming device 100D is represented by the formula $VD=IR+\omega KE$ where I denotes a current value of the intermediate transfer drive motor 200, V denotes a power supply voltage, D denotes a PWM value, KE denotes an induction voltage coefficient, $\omega$ denotes a rotational speed of the intermediate transfer drive motor 200, and R denotes a coil resistance of the intermediate transfer drive motor 200. Therefore, the current value computing unit 370 computes a current value: $I=(VD-\omega KE)/R$ as the current value of the intermediate transfer drive motor 200 based on the relationship between PWM value and the current value.

The output monitoring unit 500D of the image forming device 100D of this embodiment controls the rotational speed of secondary transfer roller 71, when the current value computed by current value computing unit 370 is detected as a torque command value and the detected current value drops below a predetermined value.

Although the output monitoring unit 500D of this embodiment has the same functional composition as output monitoring unit 500 of the first embodiment, it is different from the first embodiment at the point when a torque command value is set equal to the current value computed by current value computing unit 370. The upper limit and lower limit of the torque command value based on the torque of region Z shown in FIG. 6 are set to the upper-limit/lower-limit setting unit 510C included in the output monitoring unit 500D of this embodiment.

That is, the upper limit of the torque command value set as the upper-limit/lower-limit setting unit 510C is a current value corresponding to torque command value T3, and the lower limit of the current value set as the upper-limit/lower-limit setting unit 510C is a current value corresponding to torque command value T5.

The torque command value detecting unit 520C detects periodically the current value computed by the current value computing unit 370.

The judgment unit 530C determines whether the current value detected by the torque command value detecting unit 520C exceeds the upper limit or the lower limit set by the upper-limit/lower-limit setting unit 510C.

The target value command unit 540 outputs the command to increase a rotational speed of the secondary transfer roller 71, to the speed control unit 600A, when it is determined that the current value detected by the torque command value detecting unit 520C has exceeded the upper limit.

The target value command unit 540 outputs the command to decrease a rotational speed of the secondary transfer roller 71 to the speed control unit 600A, when it is determined that the current value detected by the torque command value detecting unit 520C has exceeded the lower limit.

Operation of the image forming device 100D of this embodiment is the same as that of the first embodiment described above, except the PWM value in the first embodiment being made into the current value computed by the current value computing unit 370. Thus, in this embodiment, the current value of the intermediate transfer drive motor 200 is computed, and the computed current value is detected as a torque command value.

Based on the detected torque command value, the rotational speed of secondary transfer roller 71 is controlled. Therefore, according to this embodiment, an appropriate speed control can be carried out to eliminate speed fluctuations of the peripheral speed of the secondary transfer roller 71 and the surface speed of the intermediate transfer belt 51 without increasing the number of component parts and the cost.

In this embodiment, the intermediate transfer drive motor driving unit 300, the output monitoring unit 500D, and the speed control unit 600A may be integrated into a semiconductor device 700D as shown in FIG. 20. In this case, the image forming device 100D can perform the functions of the above-mentioned units 300, 500D, and 600A by mounting the semiconductor device 700D in the image forming device 100D.

Next, the fifth embodiment of the invention will be explained. The fifth embodiment of the invention is a modification of the first embodiment and the fourth embodiment.

The fifth embodiment differs from the first embodiment in that the current value of the intermediate transfer drive motor 200 is detected as a torque command value. Other components of the fifth embodiment are the same as that of the first embodiment. A description will be given of only the difference between the fifth embodiment and the first embodiment. In the fifth embodiment, the elements which are the same as corresponding elements the first embodiment are designated by the same reference numerals, and a description thereof will be omitted.

Figure 22:
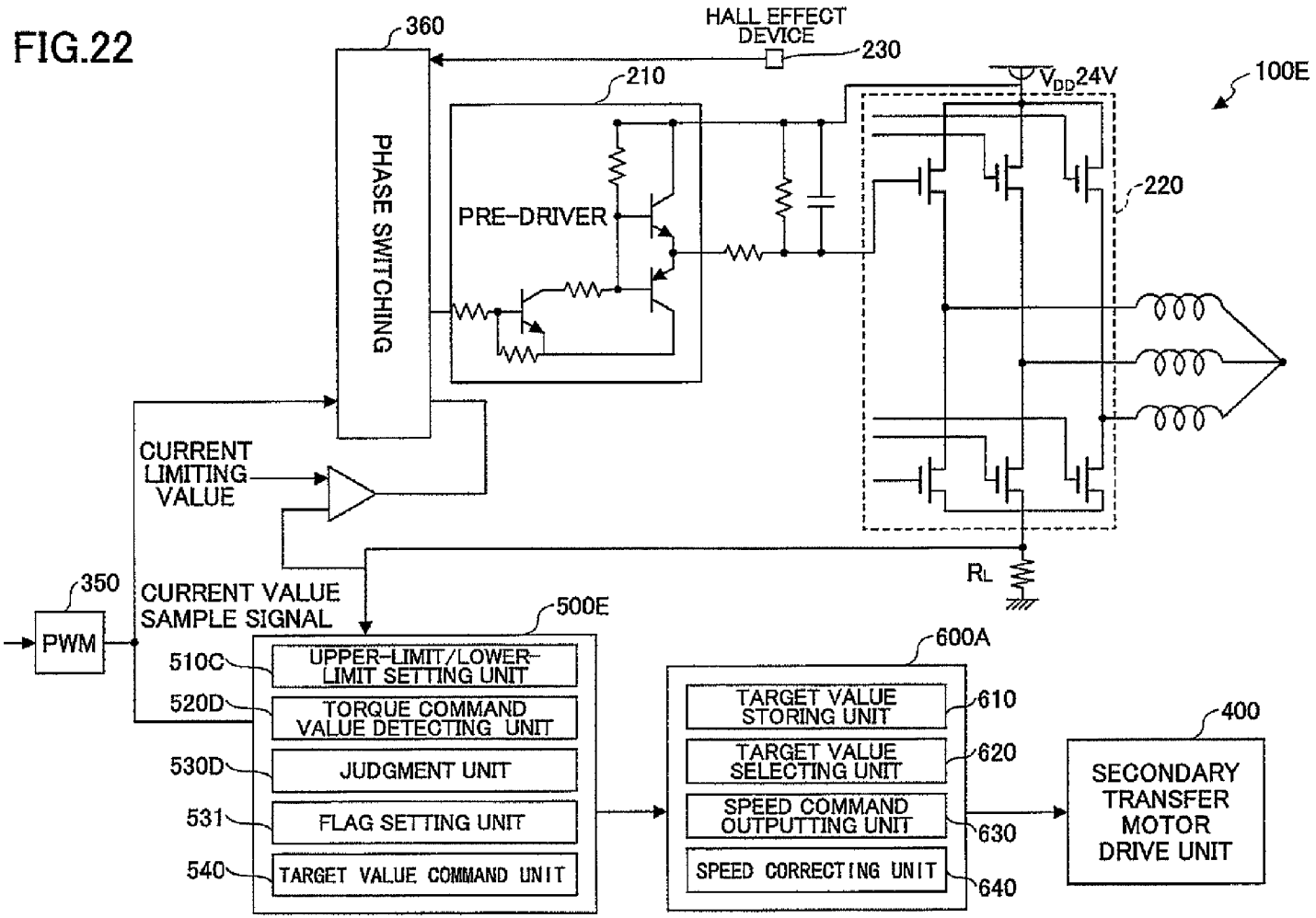
FIG. 22 is a diagram for explaining the detection of a current value performed by an image forming device of a fifth embodiment of the invention.

FIG. 22 is a diagram for explaining the detection of a current value performed by the image forming device 100E of the fifth embodiment.

The output monitoring unit 500E in the image forming device 100E of this embodiment detects the current value of the intermediate transfer drive motor 200 as a torque command value. The output monitoring unit 500E detects the current value of the intermediate transfer drive motor 200 by detecting a voltage of the resistor RL connected between the FET 220 and the ground.

Next, the output monitoring unit 500E of this embodiment will be explained.

The output monitoring unit 500E of this embodiment includes an upper-limit/lower-limit setting unit 510C, a torque command value detecting unit 520D, a judgment unit 530D, a flag setting unit 531, and a target value command unit 540.

The upper-limit/lower-limit setting unit 510C is the same as for the fourth embodiment having explained.

The torque command value detecting unit 520D samples the voltage of the resistor RL at a predetermined timing, based on the PWM signal output from the PWM unit 350, and detects the current value of the intermediate transfer drive motor 200.

The judgment unit 530D determines whether the current value detected by the torque command value detecting unit 530D exceeds the upper limit or drops below the lower limit set by the upper-limit/lower-limit setting unit 510C.

The target value command unit 540D outputs the command to increase the rotational speed of the secondary transfer roller 71 to the speed control unit 600A, when it is determined that the current value detected by torque command value detecting unit 530D has exceeded the upper limit.

The target value command unit 540 outputs the command to decrease the rotational speed of the secondary transfer roller 71 to the speed control unit 600A, when it is determined that the current value detected by the torque command value detecting unit 520C has dropped below the lower limit.

Operation of the image forming device 100E of this embodiment is the same as that of the first embodiment described above, except the PWM value in the first embodiment is set equal to the current value of the intermediate transfer drive motor 200. Thus, in this embodiment, the current value of the intermediate transfer drive motor 200 is detected as a torque command value. Based on the detected torque command value, the rotational speed of the secondary transfer roller 71 is controlled. Therefore, according to this embodiment, an appropriate speed control can be carried out to eliminate speed fluctuations of the peripheral speed of the secondary transfer roller 71 and the surface speed of the intermediate transfer belt 51 without increasing the number of component parts and the cost.

In the image forming device of this embodiment, the intermediate transfer drive motor driving unit 300, the output monitoring unit 500E, and the speed control unit 600A may be integrated into a semiconductor device. In this case, the image forming device 100E can perform the functions of the above-mentioned units 300, 500E, and 600A by mounting the semiconductor device containing the above-mentioned units 300, 500E and 600A, in the image forming device 100E.

Next, the image forming device of a sixth embodiment of the invention will be explained. The image forming device of the sixth embodiment is arranged to control the limiting value (current-limiting value) of the current which flows into the secondary transfer motor.

In FIGS. 23 to 26, the elements in this embodiment which are the same as corresponding elements in the first embodiment described above are designated by the same reference numerals, and a description thereof will be omitted.

Figure 23:
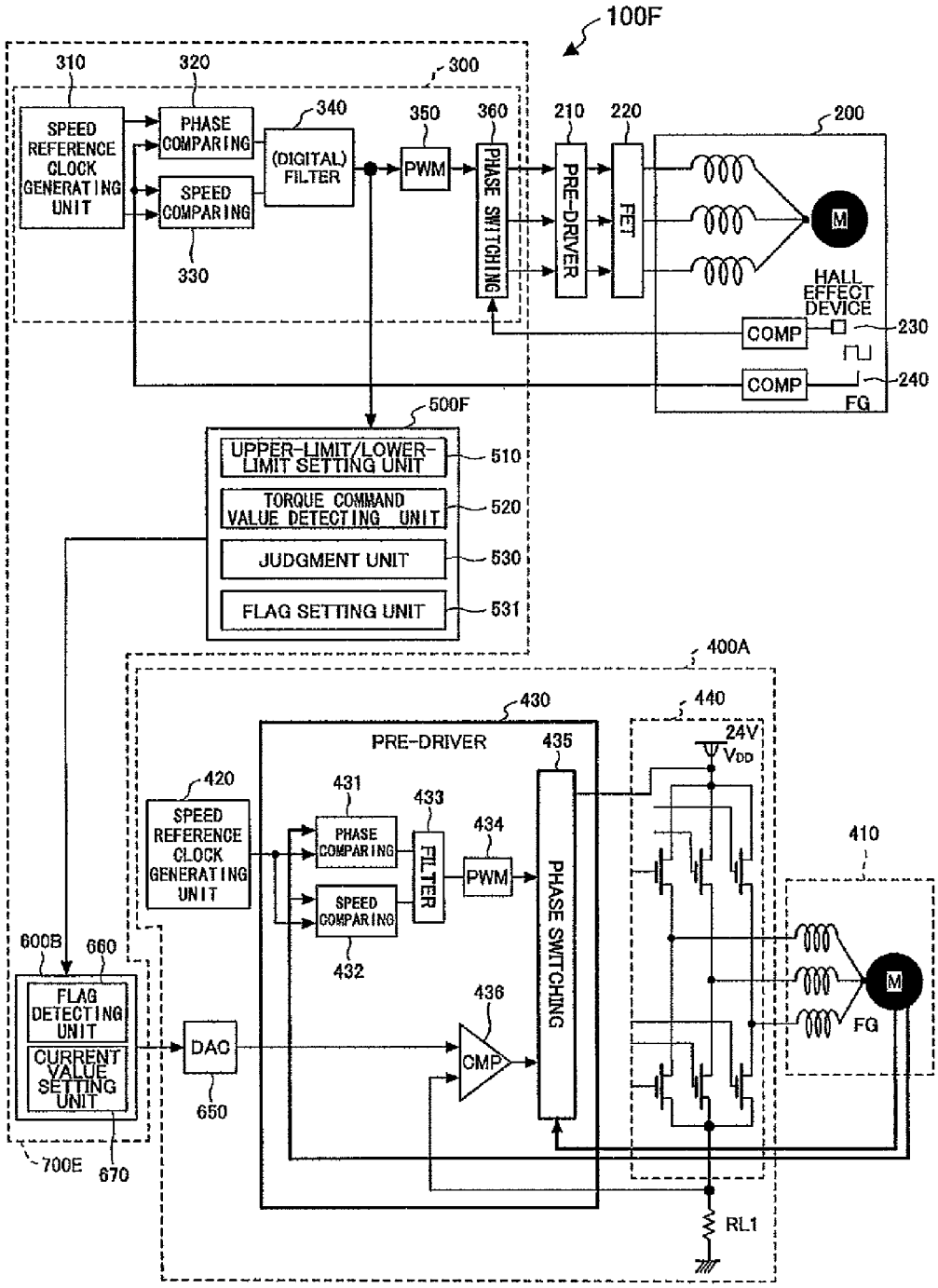
FIG. 23 is a block diagram showing the composition of an image forming device of a sixth embodiment of the invention.

FIG. 23 shows the composition of the image forming device 100F of the sixth embodiment. The image forming device 100F includes an intermediate transfer drive motor 200, a pre-driver 210, an FET 220, an intermediate transfer drive motor driving unit 300, a secondary transfer motor drive unit 400A, an output monitoring unit 500F, and a current limiting unit 600B.

The current limiting unit 600B in this embodiment limits a current value supplied to the secondary transfer motor drive unit 400A, based on the output from the output monitoring unit 500F. Specifically, a current-limiting value supplied to the secondary transfer motor drive unit 400A is controlled so that the current value is limited. This current-limiting value is set up beforehand for the secondary transfer motor drive unit 400A, and it indicates an upper limit of the current value which is supplied to the secondary transfer motor 410.

The secondary transfer motor drive unit 400A in this embodiment will be explained. The secondary transfer motor drive unit 400A rotates the secondary transfer motor 410. The secondary transfer motor drive unit 400A includes a reference clock generating unit 420, a pre-driver 430, an FET 440, and a DAC (digital-to-analog converter) 650. The speed reference clock generating unit 420 generates a speed reference clock for supplying the speed command, in response to a received speed command value.

The pre-driver 430 is a driver arranged in the preceding location of the FET 440. The pre-driver 430 includes a phase comparing unit 431, a speed comparing unit 432, a digital filter 433, a PWM unit 434, a phase switching unit 435, and a comparator 436.

The phase comparing unit 431 compares the phase of a rotational speed detected by a frequency generator FG (not shown) included in the secondary transfer motor 410, with the phase of the clock generated by the speed reference clock generating unit 420. The speed comparing unit 432 compares the speed of the rotational speed detected by the FG with the speed of the clock generated by the speed reference clock generating unit 420.

The digital filter 433 performs addition and smoothing of the comparison output from the phase comparing unit 431 and the comparison output from the speed comparing unit 432, and outputs the resulting signal to the PWM unit 434 as a PWM value. The PWM unit 434 converts the output of the digital filter 433 into a PWM signal and outputs the PWM signal to the phase switching unit 435. This PWM value indicates a current command value to determine the on-duty of the PWM signal output from the PWM unit 434.

The phase switching unit 435 performs switching of the phase of the secondary transfer motor 410 based on the PWM signal output from the PWM unit 434 and the Hall signal output from a Hall effect device (not shown) included in the secondary transfer motor 410.

The comparator 436 compares the current-limiting value output from the DAC 650 (which will be described later) with the current value of the secondary transfer motor 410. The current value of the secondary transfer motor 410 is detected by using a resistor RL1 connected between the FET 440 and the ground.

The DAC 650 converts the current-limiting value output from the current limiting unit 600B into an analog value. The resulting analog value is input to the comparator 436 included in the pre-driver 430. The output of the comparator 436 is reversed when the current value of the secondary transfer motor 410 exceeds the analog value output from the DAC 650.

The output monitoring unit 500F in this embodiment includes an upper-limit/lower-limit setting unit 510, a torque command value detecting unit 520, a judgment unit 530, and a flag setting unit 531. The flag setting unit 531 sets, when the PWM value detected by the torque command value detecting unit 520 exceeds the upper limit or drops below the lower limit, the flag which indicates that the control of a current-limiting value to the current limiting unit 600B is to be performed.

The current limiting unit 600B in this embodiment includes a flag detecting unit 660 and a current-limiting value setting unit 670. The flag detecting unit 660 detects whether the flag, which indicates the control of a current-limiting value to the current limiting unit 600B is to be performed, is set. When the flag is set, the current-limiting value setting unit 670 sets up again the current-limiting value of the secondary transfer motor 410.

Figure 24:
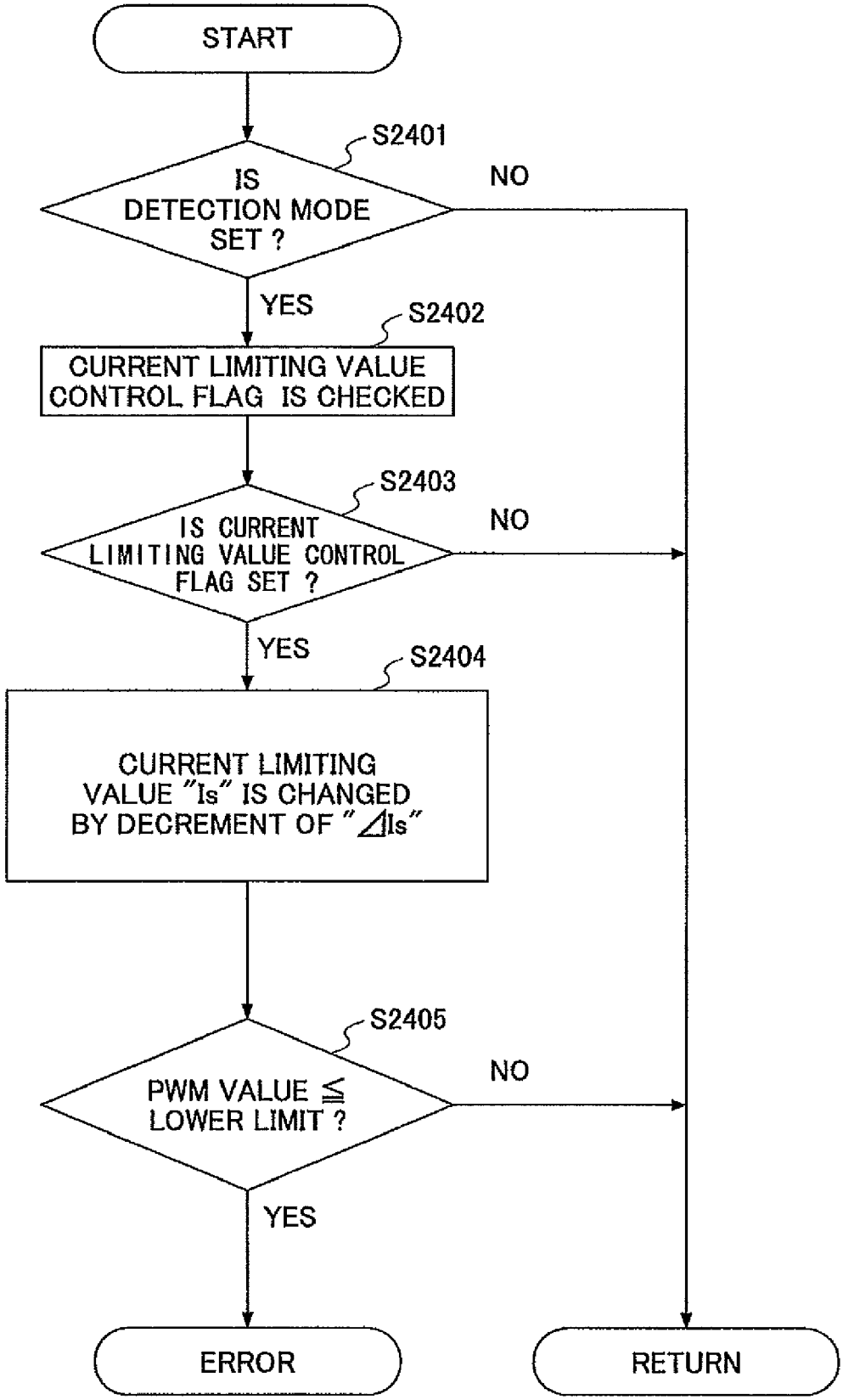
FIG. 24 is a flowchart for explaining the control of a current-limiting value performed by the image forming device of the sixth embodiment.

Next, the operation of the image forming device 100F of this embodiment will be explained with reference to FIG. 24. FIG. 24 is a flowchart for explaining the control of a current-limiting value performed by the image forming device of the sixth embodiment.

As shown in FIG. 24, in step S2401, the current limiting unit 600B in this embodiment checks whether the detection mode to detect the PWM value is set up, by receiving the output from the output monitoring unit 500F.

Progressing to step S2402, the flag detecting unit 660 checks whether the flag which indicates the control of a current-limiting value to the current limiting unit 600B is to be performed is set.

When the flag is set in step S2403, the control progresses to step S2404. Otherwise the control is returned to the output monitoring unit 500F. The output monitoring unit 500F in this embodiment may be arranged so that, only when the PWM value is smaller than the lower limit, the flag is set to the current limiting unit 600B.

In step S2404, the current-limiting value setting unit 670 sets up again the current-limiting value of the secondary transfer motor 410 and changes the current-limiting value. Specifically, when the PWM value is smaller than the lower limit, the current-limiting value setting unit 670 changes the setting of the current-limiting value from a threshold Is of the current-limiting value of the secondary transfer motor 410 by decrements of ⊿Is, so that the current-limiting value of the secondary transfer motor 410 is decreased gradually.

Progressing to step S2505, the output monitoring unit 500F determines whether the PWM value after the setting of the current-limiting value is changed is smaller than the lower limit.

When the PWM value is still smaller than the lower limit in step S2405, it is determined that an error arises, and the current-limiting value setting unit 670 repeats the processing of step S2404 and performs the control to change the current-limiting value Is in decrements of ⊿Is until the resulting PWM value drops below the lower limit.

The current-limiting value set up by the current-limiting value setting unit 670 is converted into an analog value by the DAC 650. The resulting analog value is supplied to one input of the comparator 436. The current value of the secondary transfer motor 410 detected by the resistor RL1 is supplied to the other input of the comparator 436. The output of the comparator 436 is supplied to the phase switching unit 435. The output of the comparator 436 is reversed when the current value of the secondary transfer motor 410 is larger than the analog value.

If reversal of the output signal of the comparator 436 is received, the phase switching unit 435 determines that the current value of the secondary transfer motor 410 has exceeded the current-limiting value. The phase switching unit 435 cuts the on-duty of the PWM signal in the period when it is determined that the current-limiting value has been exceeded. This PWM signal is a signal output from the PWM unit 434 to the phase switching unit 435.

As described above, in this embodiment, the current value of the secondary transfer motor 410 is limited by using the current limiting unit 600B, the DAC 650, and the comparator 436. In the above-mentioned embodiment, the secondary transfer motor drive unit 400A is arranged to include the DAC 650. Alternatively, the DAC 650 may be arranged outside the secondary transfer motor drive unit 400A.

Figure 25:
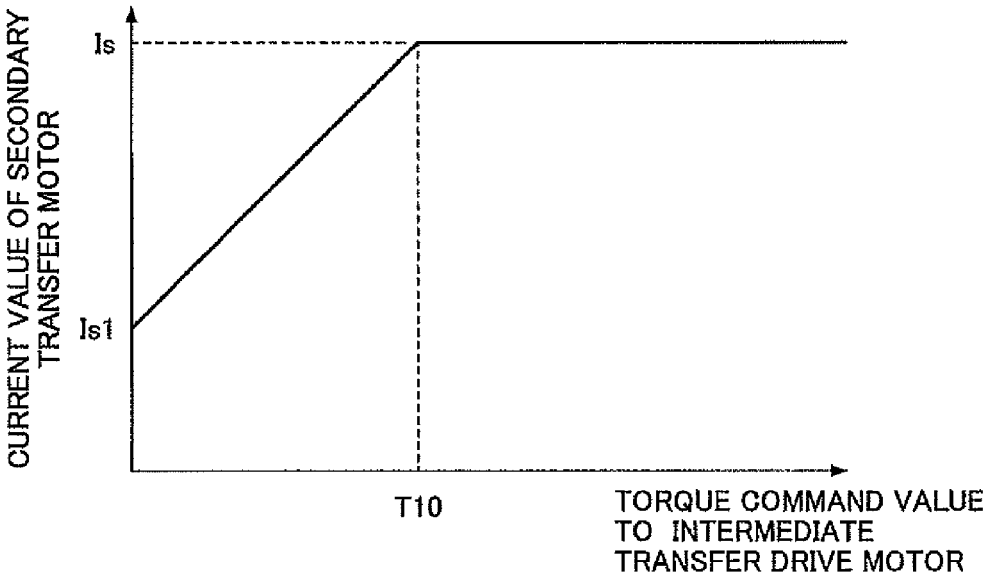
FIG. 25 is a diagram for explaining the relationship between a torque command value to the intermediate transfer drive motor and a current value of the secondary transfer motor in the image forming device of the sixth embodiment.

FIG. 25 is a diagram for explaining the relationship between a torque command value to the intermediate transfer drive motor 200 and a current value of the secondary transfer motor 410 in the image forming device of the sixth embodiment.

In this embodiment, for example, when the torque command value to the intermediate transfer drive motor 200 is smaller than the lower limit T10, the current-limiting value of the secondary transfer motor 410 changes gradually from Is to Is1 (by decrements of ⊿Is) by the current-limiting value control as shown in FIG. 25. For example, the torque command value T10 in this case is equivalent to a torque command value based on the torque T5 at the operating point A as indicated in FIG. 6.

Figure 26:
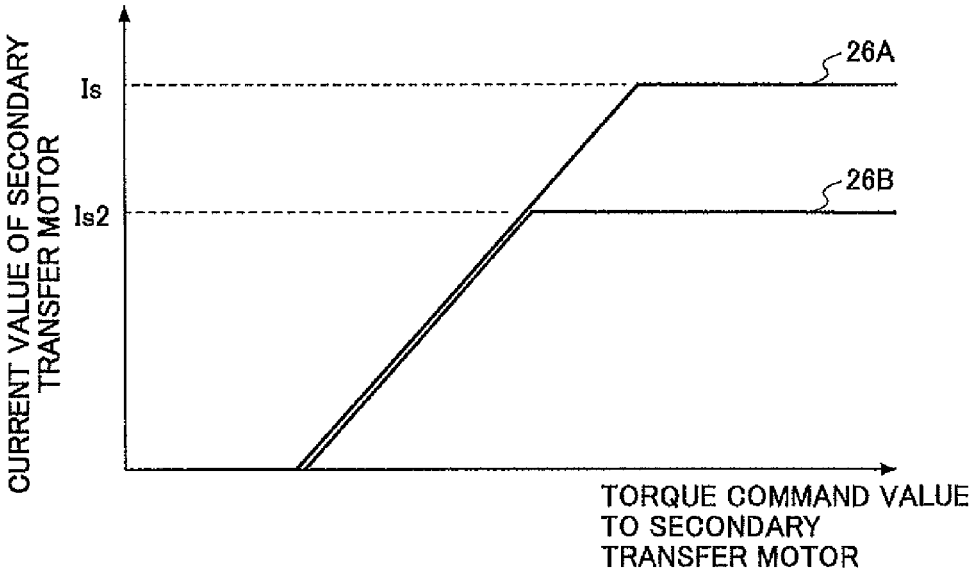
FIG. 26 is a diagram for explaining the relationship between a torque command value and a current value of the secondary transfer motor in the image forming device of the sixth embodiment.

FIG. 26 is a diagram for explaining the relationship between a torque command value and a current value of the secondary transfer motor 410 in the image forming device of the sixth embodiment.

As shown in FIG. 26, when the torque command value to the secondary transfer motor 410 exceeds the reverse electromotive voltage by the rotation of the motor, the current starts flowing into the secondary transfer motor 410. The current value of the secondary transfer motor 410 increases as the torque command value to the secondary transfer motor 410 increases. When the current value of the secondary transfer motor 410 reaches the current-limiting value, the current value is held at a fixed level regardless of the change in the torque command value.

In a case where the current-limiting value in the secondary transfer motor 410 of this embodiment is set to a high level "Is" as indicated by the solid line 26A in FIG. 26, when the current value of the secondary transfer motor 410 reaches the current-limiting value, the current value is held at the fixed high level "Is" regardless of the change in the torque command value.

In a case where the current-limiting value in the secondary transfer motor 410 of this embodiment is set to a low level "Is2" as indicated by the solid line 268 in FIG. 26, when the current value of the secondary transfer motor 410 reaches the current-limiting value, the current value is held at the fixed high level "Is" regardless of the change in the torque command value.

Thus, in this embodiment, the current-limiting value of the secondary transfer motor 410 is controlled, which enables the driving of the secondary transfer roller 71 to be controlled. Accordingly, it is possible for the image forming device of this embodiment to control the rotational speed of the secondary transfer roller 71 so that a difference between the peripheral speed of the secondary transfer roller 71 and the surface speed of the intermediate transfer belt 51 always falls within the relative-speed tolerance H2 (refer to FIG. 6).

In this embodiment, the intermediate transfer drive motor driving unit 300, the output monitoring unit 500F, and the current limiting unit 600B may be integrated into a semiconductor device 700E as shown in FIG. 23. In this case, the image forming device 100F can perform the functions of the above-mentioned units 300, 500F, and 600B by mounting the semiconductor device 700E in the image forming device 100F.

The present invention is not limited to the specifically disclosed embodiments, and variations and modifications may be made without departing from the scope of the present invention.

The present application is based on Japanese patent application No. 2007-145536, filed on May 31, 2007, and Japanese patent application No. 2008-112673, filed on Apr. 23, 2008, the contents of which are incorporated herein by reference in their entirety.

What is claimed is:

1. An image forming device comprising:

a first rotary member;

a first motor arranged to rotate the first rotary member by a torque on a shaft of the first rotary member;

a second rotary member located to influence the torque on the shaft of the first rotary member;

a second motor arranged to rotate the second rotary member;

a first motor driving unit arranged to drive the first motor;

a second motor driving unit arranged to drive the second motor;

a torque command value detecting unit configured to detect a torque command value which is output from the first motor driving unit to the first motor;

a storing unit configured to store a lower limit of the torque command value;

a judgment unit configured to determine whether the torque command value detected by the torque command value detecting unit exceeds the lower limit; and a drive control unit configured to control driving of the second motor driving unit based on a result of the determination of the judgment unit.

2. The image forming device according to claim 1, wherein the storing unit is configured to store an upper limit of the torque command value, and the judgment unit is configured to determine whether a torque command value detected by the torque command value detecting unit exceeds the upper limit.

3. The image forming device according to claim 1, further comprising a PWM control unit configured to control the first motor, wherein the torque command value detecting unit is configured to detect a current command value supplied to the PWM control unit as being a torque command value, and the judgment unit is configured to determine whether the current command value exceeds the upper limit or drops below the lower limit.

4. The image forming device according to claim 3, wherein the storing unit is configured to store a first lower limit and a second lower limit of the current command value, and the judgment unit is configured to determine whether a current command value detected by the torque command value detecting unit drops below the first lower limit and the second lower limit in a predetermined time.

5. The image forming device according to claim 3, wherein the torque command value detecting unit is configured to detect a lower limit of the current command value based on a detected current command value, the storing unit is configured to store a value which is produced by adding a predetermined tolerance to the lower limit detected by the torque command value detecting unit, and the judgment unit is configured to determine whether a current command value detected by the torque command value detecting unit is smaller than the value which is produced by adding the predetermined tolerance to the lower limit.

6. The image forming device according to claim 1, further comprising:

a PWM control unit configured to control the first motor;

a rotational speed detecting unit configured to detect a rotational speed of the first motor; and a current value computing unit configured to compute a current value of the first motor based on a current command value supplied to the PWM control unit and a rotational speed detected by the rotational speed detecting unit, wherein the torque command value detecting unit is configured to detect a current value computed by the current value computing unit as being the torque command value.

7. The image forming device according to claim 1, further comprising a current value detecting unit configured to detect a current value of the first motor, wherein the torque command value detecting unit is configured to detect a current value detected by the current value detecting unit as being the torque command value.

8. The image forming device according to claim 1, wherein the control unit comprises a speed control unit configured to control a speed of the second rotary member so that a difference between a speed of the first rotary member and a speed of the second rotary member falls within a predetermined range.

9. The image forming device according to claim 8, wherein the speed control unit comprises:

a target value storing unit configured to store a plurality of target values with respect to a rotational speed of the second rotary member;

a target value selecting unit configured to select a target value from among the plurality of target values stored in the target value storing unit; and a speed command outputting unit configured to output the target value selected by the target value selecting unit as being a speed command value.

10. The image forming device according to claim 9, wherein the target value selecting unit is configured to select a target value which causes a difference between the speed of the second rotary member and the speed of the first rotary member to fall within the predetermined range.

11. The image forming device according to claim 9, wherein the target value selecting unit is configured to select a target value which minimizes a difference between the speed of the second rotary member and the speed of the first rotary member.

12. The image forming device according to claim 1, wherein the drive control unit comprises a current limiting unit configured to limit a current value of the second rotary member so that a difference between a speed of the first rotary member and a speed of the second rotary member falls within a predetermined range.

13. The image forming device according to claim 12, wherein the current limiting unit comprises a current-limiting value storing unit configured to store a current-limiting value of the second rotary member, and the current-limiting value storing unit is configured to store a current-limiting value which causes the difference between the speed of the first rotary member and the speed of the second rotary member to fall within the predetermined range.

14. An image forming device comprising:

a first rotary member;

a first motor arranged to rotate the first rotary member by a torque on a shaft of the first rotary member;

a second rotary member located to influence the torque on the shaft of the first rotary member;

a second motor arranged to rotate the second rotary member;

a first motor driving unit arranged to drive the first motor;

a second motor driving unit arranged to drive the second motor;

a semiconductor device comprising:

a torque command value detecting unit configured to detect a torque command value which is output from the first motor driving unit to the first motor;

a storing unit configured to store a lower limit of the torque command value;

a judgment unit configured to determine whether the torque command value detected by the torque command value detecting unit exceeds the lower limit; and a drive control unit configured to control driving of the second motor driving unit based on a result of the determination of the judgment unit.

15. The image forming device according to claim 1, wherein the first rotary member constitutes an intermediate transfer belt, the first motor constitutes an intermediate transfer drive motor, the second rotary member constitutes a secondary transfer roller arranged to transfer a toner image from the intermediate transfer belt to a recording sheet, and the second motor constitutes a secondary transfer motor.

16. The image forming device according to claim 1, wherein the second rotary member is located to influence the torque on the shaft of the first rotary member through a recording sheet.

* * * * *